US009954265B2

(12) United States Patent
Shen et al.

(10) Patent No.: US 9,954,265 B2
(45) Date of Patent: Apr. 24, 2018

(54) TWO-TRANSMITTER TWO-RECEIVER ANTENNA COUPLING UNIT FOR MICROWAVE DIGITAL RADIOS

(71) Applicant: ZTE CORPORATION, Shenzhen (CN)

(72) Inventors: Ying Shen, Chapel Hill, NC (US); Edwin John Nealis, Cary, NC (US); Zhuo Li, Xi'an (CN); Zhiping Feng, Chapel Hill, NC (US); Thanh Hung Nguyen, Cary, NC (US)

(73) Assignee: ZTE CORPORATION, Shenzhen (CN)

( * ) Notice: Subject to any disclaimer, the term of this patent is extended or adjusted under 35 U.S.C. 154(b) by 137 days.

(21) Appl. No.: 14/951,016

(22) Filed: Nov. 24, 2015

(65) Prior Publication Data

US 2016/0149283 A1 May 26, 2016

Related U.S. Application Data

(60) Provisional application No. 62/085,077, filed on Nov. 26, 2014.

(51) Int. Cl.

| | |
|---|---|
| ***H01P 5/12*** | (2006.01) |
| ***H01P 1/213*** | (2006.01) |
| ***H01P 1/36*** | (2006.01) |
| ***H01P 1/39*** | (2006.01) |

(52) U.S. Cl.
CPC ..... *H01P 1/2138* (2013.01); *H01P 1/36* (2013.01); *H01P 1/39* (2013.01)

(58) Field of Classification Search
CPC ..... H01P 1/213; H01P 1/2183; H01P 5/12; H01P 1/36; H01P 1/39; H04B 1/0475; H04B 10/90; H04B 1/52
See application file for complete search history.

(56) References Cited

U.S. PATENT DOCUMENTS

| | | | | |
|---|---|---|---|---|
| 3,636,452 A * | 1/1972 | Nuding | H04B 7/145 | 333/1.1 |
| 5,212,813 A * | 5/1993 | Renaud | H01P 1/213 | 343/858 |
| 8,552,809 B2 * | 10/2013 | Nealis | H01P 1/39 | 333/1.1 |
| 2015/0065184 A1 * | 3/2015 | Nealis | H04B 1/0475 | 455/500 |

* cited by examiner

*Primary Examiner* — Robert J Pascal
*Assistant Examiner* — Kimberly Glenn
(74) *Attorney, Agent, or Firm* — Morgan, Lewis & Bockius LLP

(57) ABSTRACT

An antenna coupling device is disclosed. The device includes a first isolator that includes an input port and an output port and a first circulator that includes a first port, a second port, and a third port. The first port of the first circulator is coupled with the output port of the first isolator; and the second port of the first circulator is configured for coupling with a first antenna. The device also includes a second isolator that includes an input port and an output port. The input port of the second isolator is coupled with the third port of the first circulator.

20 Claims, 16 Drawing Sheets

TWO-TRANSMITTER TWO-RECEIVER ANTENNA COUPLING UNIT FOR MICROWAVE DIGITAL RADIOS

RELATED APPLICATIONS

The present application claims benefit of priority under 35 U.S.C. § 119 to U.S. Provisional Application No. 62/085,077, filed on Nov. 26, 2014, titled "Two-Transmitter Two-Receiver Antenna Coupling Unit for Microwave Digital Radios," content of which is hereby incorporated by reference in its entirety.

TECHNICAL FIELD

The present application generally relates to devices for routing radio-frequency or microwave signals and, more particularly, devices for coupling receivers and transmitters with one or more antennas.

BACKGROUND

Point-to-point digital microwave radios play an increasingly important role in wireless communications systems. Conventional antenna coupling devices include signal splitters. However, splitters significantly reduce the power of transmitted signals. For example, signals transmitted through a splitter can lose more than 50% of power, which leads to higher power consumptions, which is undesirable in wireless communications.

SUMMARY

Thus, there is a need for antenna coupling devices that are more efficient in routing signals to and from an antenna. As described herein, some antenna coupling devices provide better isolation between a transmission filter and a receiver filter. Some antenna coupling devices have a lower filter rejection requirement and a smaller filter size. Some antenna coupling devices have a better (e.g., lower) antenna port return loss. Some antenna coupling devices provide additional system gain (e.g., 6 dB) for configurations of 1+1FD and 2+0 PLA comparing with traditional duplexer with external isolator approach. In some embodiments, a circulator plate is used to support configuration for multiple two-transmitter-two-receiver configurations. Some antenna coupling devices that include the circulator plate have a small size and a lower cost, compared with devices with a traditional duplexer and an external isolator. Some antenna coupling devices are also easier to implement tunable filter capability for a two-transmitter-two-receiver radio. In some embodiments, a smaller filter is used for a higher frequency band. Thus, further size reduction is possible through integration with a dual transmitter-receiver module at high microwave and millimeter wave bands. In some embodiments, the circulator plate provides next level integration capability for the radio integration. Such devices optionally complement or replace conventional antenna coupling devices.

In accordance with some embodiments, an antenna coupling device for routing microwave signals includes a first isolator that includes an input port and an output port and a first circulator that includes a first port, a second port, and a third port, and a first filter that includes an input port and an output port. The input port of the first filter is coupled with the output port of the first isolator. The first port of the first circulator is coupled with the output port of the first filter; and the second port of the first circulator is configured for coupling with a first antenna. The device also includes a second isolator that includes an input port and an output port, and a second filter that includes an input port and an output port. The output port of the second filter is coupled with the input port of the second isolator. The input port of the second filter is coupled with the third port of the first circulator. In some embodiments, the first isolator, the first circulator, and the second isolator are formed using a single plate (also called herein a circulator plate). The first filter and the second filter are separate and coupled with the circulator plate through the waveguide ports.

In accordance with some embodiments, an antenna coupling device includes a first receiver filter that includes an input port and an output port; a second receiver filter that includes an input port and an output port; a first transmitter filter that includes an input port and an output port; a second transmitter filter that includes an input port and an output port; and a first circulator that includes a first port, a second port, and a third port. The first port of the first circulator is coupled with the output port of the first transmitter filter; and the third port of the first circulator is coupled with the output port of the second transmitter filter. The device also includes a second circulator that includes a first port, a second port, and a third port. The second port of the second circulator is coupled with the input port of the first receiver filter; and the third port of the second circulator is coupled with the input port of the second receiver filter. The device further includes a third circulator that includes a first port, a second port, and a third port. The first port of the third circulator is coupled with the second port of the first circulator; and the third port of the third circulator is coupled with the first port of the second circulator.

In accordance with some embodiments, a two-transmitter two-receiver wireless communication system includes a first receiver; a second receiver; a first transmitter; a second transmitter; and an antenna coupling device selected from a plurality of antenna coupling devices. The first receiver, the second receiver, the first transmitter, the second transmitter are configured for coupling with any antenna coupling device of the plurality of antenna coupling devices. Each antenna coupling device of the plurality of antenna coupling devices has an input waveguide port for coupling with the first receiver at a same first location and an output waveguide port for coupling with the first transmitter at a same second location. The first receiver, the second receiver, the first transmitter, the second transmitter are coupled with the antenna coupling device. In some embodiments, each antenna coupling device of the plurality of antenna coupling devices has an input waveguide port for coupling with the second receiver at a same third location and an output waveguide port for coupling with the second transmitter at a same fourth location.

BRIEF DESCRIPTION OF DRAWINGS

The accompanying drawings, which are included to provide a further understanding of the embodiments and are incorporated herein and constitute a part of the specification, illustrate the described embodiments and together with the description serve to explain the underlying principles. Like reference numerals refer to corresponding parts.

DETAILED DESCRIPTION

Reference will now be made in detail to embodiments, examples of which are illustrated in the accompanying drawings. In the following detailed description, numerous non-limiting specific details are set forth in order to assist in understanding the subject matter presented herein. It will be apparent, however, to one of ordinary skill in the art that various alternatives may be used without departing from the scope of claims and the subject matter may be practiced without these specific details. For example, it will be apparent to one of ordinary skill in the art that the subject matter presented herein can be implemented on many types of radio communication systems.

Figure 1:
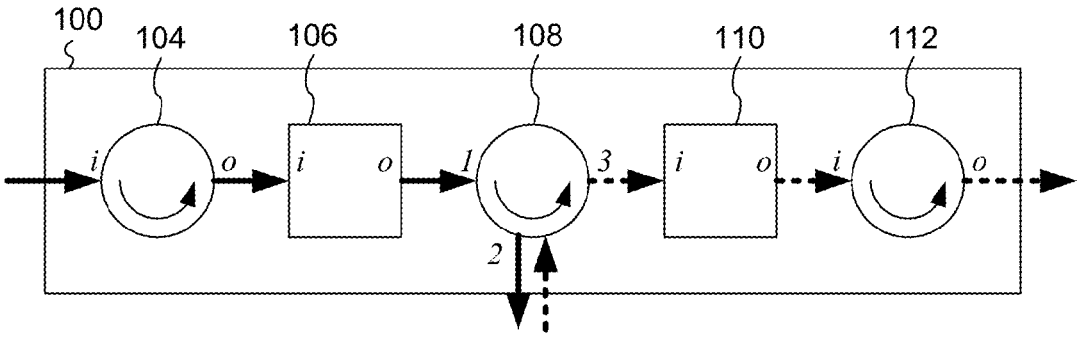
FIG. 1 is a schematic diagram illustrating a device for coupling an antenna with a receiver and a transmitter in accordance with some embodiments.

FIG. 1 is a schematic diagram illustrating a device 100 for coupling an antenna with a receiver and a transmitter in accordance with some embodiments.

The device 100 includes a first isolator 104 that includes an input port (i) and an output port (o) that is distinct from the input port (i).

In some embodiments, the first isolator 104 is configured to transmit radio-frequency or microwave signals received through the input port (i) of the first isolator 104 to the output port (o) of the first isolator 104. In some embodiments, the first isolator 104 is configured to suppress radio-frequency or microwave signals received through the output port (o) of the first isolator 104 from being output through the input port (i) of the first isolator 104. For example, the first isolator 104 absorbs radio-frequency or microwave signals received through the output port (o) of the first isolator 104.

The device 100 also includes a first circulator 108 that includes a first port (1), a second port (2) distinct from the first port (1), and a third port (3) distinct from the first port (1) and the second port (2).

The first port (1) of the first circulator 108 is coupled with the output port (o) of the first isolator 104. In some embodiments, the first port (1) of the first circulator 108 is coupled with the output port (o) of the first isolator 104 through a waveguide. In some embodiments, the first port (1) of the first circulator 108 is directly coupled with the output port (o) of the first isolator 104. In some embodiments, the first port (1) of the first circulator 108 is coupled with the output port (o) of the first isolator 104 through one or more components (e.g., a filter 106). In some embodiments, the first port (1) of the first circulator 108 is coupled directly with the output port (o) of the first isolator 104.

The second port (2) of the first circulator 108 is configured for coupling with a first antenna. In some embodiments, the second port (2) of the first circulator 108 is directly coupled with the first antenna. In some embodiments, the second port (2) of the first circulator 108 is coupled with the first antenna through one or more components (e.g., a connector). For example, the second port (2) of the first circulator 108 is coupled with a port that is configured to receive a connector of the first antenna.

In some embodiments, the first circulator 108 is configured to route radio-frequency or microwave signals received through the first port (1) of the first circulator 108 to the second port (2) of the first circulator 108, and radio-frequency or microwave signals received through the second port (2) of the first circulator 108 to the third port (3) of the first circulator 108. For example, transmission signals received through the first port (1) of the first circulator 108 are output through the second port (2) of the first circulator toward the first antenna, and the signals from the first antenna are received through the second port (2) of the first circulator 108 and output through the third port (3) of the first circulator 108. In some embodiments, the first circulator 108 is configured to route radio-frequency or microwave signals received through the third port (3) of the first circulator 108 to the first port (1) of the first circulator 108. Because a significant portion (e.g., 90%) of the transmission signals received through the first port (1) of the first circulator 108 are output through the second port (2) of the first circulator and a significant portion of the signals from the first antenna are output through the third port (3) of the first circulator 108, the first circulator 108 can reduce the signal loss associated with routing the radio-frequency or microwave signals.

Figure 2:
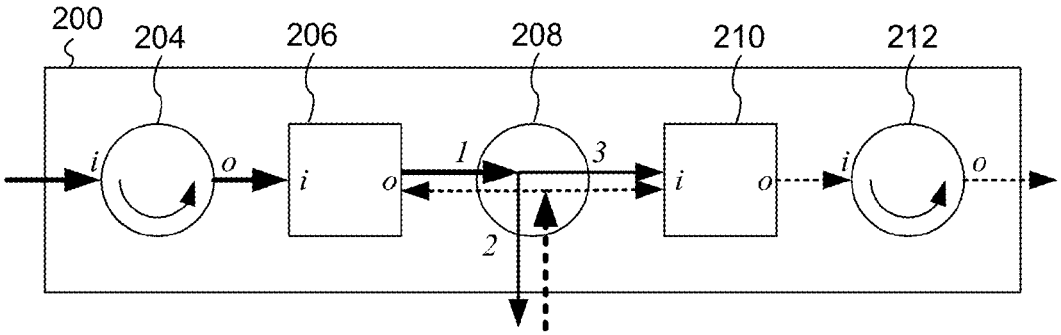
FIG. 2 is a schematic diagram illustrating a related device for coupling an antenna with a receiver and a transmitter.

FIG. 2 is a schematic diagram illustrating a related device 200 for coupling an antenna with a receiver and a transmitter. The device 200 is similar to the device 100 illustrated in FIG. 1 in that the device 200 includes an isolator 204, a filter 206, a filter 210, and an isolator 212. However, the device 200 differs from the device 100 in that the device 200 includes a T-junction 208 instead of the circulator 108 of the device 100. Receiver signals received through a first port (1) of the T-junction 208 are split toward a second port (2) and a third port (3) of the T-junction 208. The T-junction 208 also requires that filters 206 and 210 have higher performances than filters 106 and 110 in FIG. 1, because the filters 206 and 210 need to suppress the additional interfering signals. For example, the filter 210 needs to suppress the portion of the signals received through the first port (1) of the T-junction 208 and output through the third port (3) of the T-junction 208, which is not required for the filter 110 in FIG. 1. Thus, the filters 206 and 210 tend to be larger and more expensive than the filter 106 and 110 in FIG. 1, and are less desirable for making compact and inexpensive devices.

Referring back to FIG. 1, the device 100 further includes a second isolator 112 that includes an input port (i) and an output port (o) that is distinct from the input port (i). The second isolator 112 is distinct from the first isolator 104. In some embodiments, the second isolator 112 is separate from the first isolator 104.

The input port (i) of the second isolator 112 is coupled with the third port (3) of the first circulator 108. In some embodiments, the input port (i) of the second isolator 112 is directly coupled with the third port (3) of the first circulator 108. In some embodiments, the input port (i) of the second isolator 112 is coupled with the third port (3) of the first circulator 108 through one or more components (e.g., a filter 110).

In some embodiments, the second isolator 112 is configured to transmit radio-frequency or microwave signals received through the input port (i) of the second isolator 112 to the output port (o) of the second isolator 112. In some embodiments, the second isolator 112 is configured to suppress radio-frequency or microwave signals received through the output port (o) of the second isolator 112 from being output through the input port (i) of the second isolator 112.

In some embodiments, the input port (i) of the first isolator 104 is configured to couple with an output port of a first radio-frequency or microwave transmitter, and the output port (o) of the second isolator 112 is configured to couple with an input port of a first radio-frequency or microwave receiver. For example, signals from the first radio-frequency or microwave transmitter is received through the input port (i) of the first isolator 104, and signals output from the output port (o) of the second isolator 112 are sent to the first radio-frequency or microwave receiver.

In some embodiments, the first isolator 104, the first circulator 108, and the second isolator 112 are included in a single enclosure.

In some embodiments, the device 100 includes a first filter 106 that includes an input port (i) and an output port (o) that is distinct from the input port (i). In some embodiments, the first filter 106 is configured to output radio-frequency or microwave signals that satisfy a first predetermined radio-frequency or microwave band, within radio-frequency or microwave signals received through the input port (i) of the first filter 106, through the output port (o) of the first filter 106. In some embodiments, the first filter 106 is a transmitter filter (also called herein a transmission filter). In some embodiments, the first filter 106 is configured to suppress radio-frequency or microwave signals that do not satisfy the first predetermined radio-frequency or microwave band, within radio-frequency or microwave signals received through the input port (i) of the first filter 106, from being output through the output port (o) of the first filter 106. For example, when the first predetermined radio-frequency or microwave band is 10.0-10.1 GHz, the first filter 106 transmits radio-frequency or microwave signals within the 10.0-10.1 GHz band and suppresses radio-frequency or microwave signals that are outside the 10.0-10.1 GHz band. In some embodiments, the first filter 106 is configured to send back (e.g., by reflection) radio-frequency or microwave signals that do not satisfy the first predetermined radio-frequency or microwave band, within radio-frequency or microwave signals received through the input port (i) of the first filter 106, through the input port (i) of the first filter 106.

In some embodiments, the input port (i) of the first filter 106 is coupled with the output port (o) of the first isolator 104 and the output port (o) of the first filter 106 is coupled with the first port (1) of the first circulator 108 so that the first port (1) of the first circulator 108 is coupled with the output port (o) of the first isolator 104 through the first filter 106. In some embodiments, the first port (1) of the first circulator 108 is directly coupled with the output port (o) of the first isolator 104 (e.g., the first filter 106 is not located between the first circulator 108 and the first isolator 104).

In some embodiments, the first filter 106 is a tunable filter and the first predetermined radio-frequency or microwave band is tunable. In some embodiments, the first filter 106 includes a printed circuit board motor. An exemplary tunable filter is described below with respect to FIGS. 8A-8B.

In some embodiments, the device includes a second filter 110 that includes an input port (i) and an output port (o) that is distinct from the input port (i). The second filter 110 is distinct from the first filter 106. In some embodiments, the second filter 110 is separate from the first filter 106. In some embodiments, the second filter 110 is configured to output radio-frequency or microwave signals that satisfy a second predetermined radio-frequency or microwave band, within radio-frequency or microwave signals received through the input port (i) of the second filter 110, through the output port (o) of the second filter 110. In some embodiments, the second filter 110 is configured to suppress radio-frequency or microwave signals that do not satisfy the second predetermined radio-frequency or microwave band, within radio-frequency or microwave signals received through the input port (i) of the second filter 110, from being output through the output port (o) of the second filter 110. In some embodiments, the second filter 110 is a receiver filter (also called herein a reception filter). In some embodiments, the second predetermined radio-frequency or microwave band is distinct from the first predetermined radio-frequency or microwave band. In some embodiments, the second predetermined radio-frequency or microwave band does not overlap with the first predetermined radio-frequency or microwave band.

In some embodiments, the input port (i) of the second filter 110 is coupled with the third port (3) of the first circulator 108 and the output port (o) of the second filter 110 is coupled with the input port (i) of the second isolator 112 so that the third port (3) of the first circulator 108 is coupled with the input port (i) of the second isolator 112 through the second filter 110. In some embodiments, the third port (3) of the first circulator 108 is directly coupled with the input port (i) of the second isolator 112 (e.g., the second filter 110 is not located between the first circulator 108 and the second isolator 112).

In some embodiments, the second filter 110 is a tunable filter and the second predetermined radio-frequency or microwave band is tunable.

In some embodiments, the first isolator 104, the first circulator 108, and the second isolator 112 are formed using a single plate (e.g., a circulator plate). As used herein, the single plate has a broad and flat shape. An exemplary single plate that is used for forming the first isolator 104, the first circulator 108, and the second isolator 112 are described below with respect to FIGS. 4A-4C.

In some embodiments, a device 100 for coupling an antenna with a receiver and a transmitter includes a first filter 106, a first circulator 108, and a second filter 110. In some embodiments, the first filter 106, the first circulator 108, and the second filter 110 are included in a single enclosure. In some embodiments, a first isolator 104 and a second isolator 112 are located outside the single enclosure.

Figure 3A:
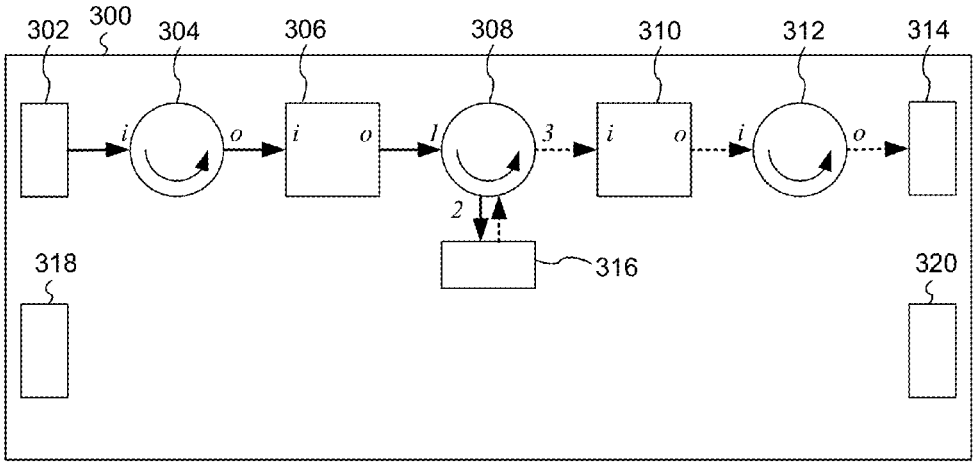
FIG. 3A is a schematic diagram illustrating a device for coupling an antenna with a receiver and a transmitter in accordance with some embodiments.
Figure 3B:
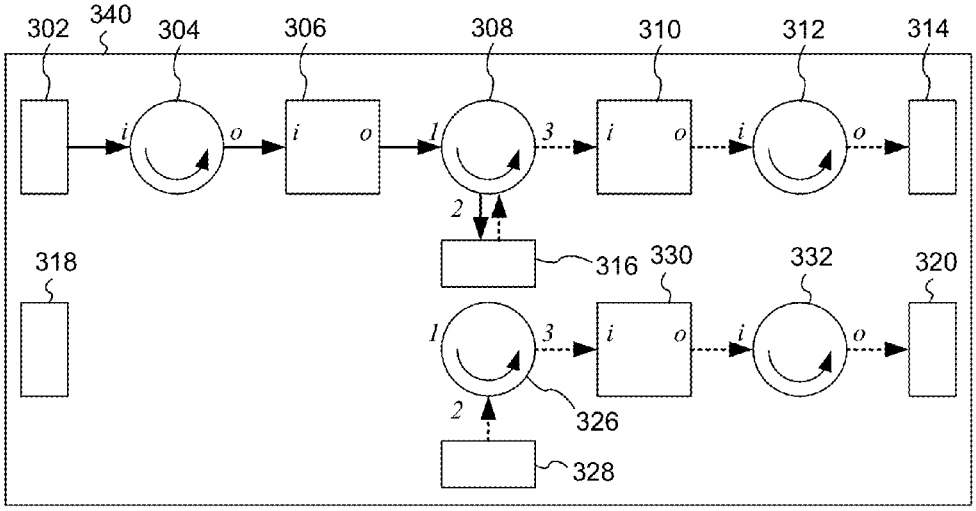
FIG. 3B is a schematic diagram illustrating a device for coupling two antennas with two receivers and a transmitter in accordance with some embodiments.
Figure 3C:
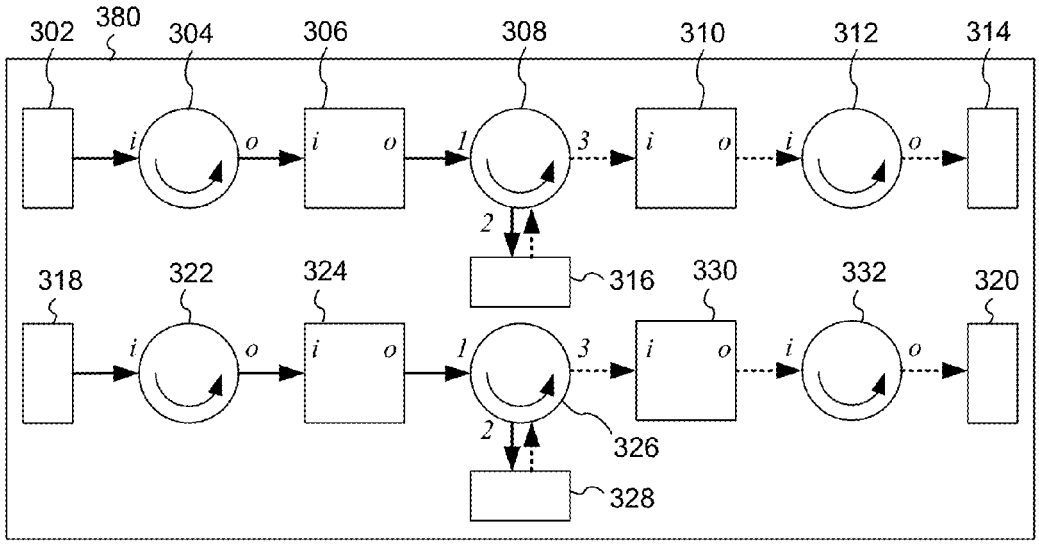
FIG. 3C is a schematic diagram illustrating a device for coupling two antennas with two receivers and two transmitters in accordance with some embodiments.

FIGS. 3A-3C are schematic diagrams illustrating devices for coupling one or more antennas with one or more receivers and one or more transmitters in accordance with some embodiments. In some embodiments, the devices illustrated in FIGS. 3A-3C are formed on a single plate. In some embodiments, the single plate is configured for coupling with two receivers and two transmitters. This configuration is often known as a two-transmitter two-receiver (2T2R) architecture.

FIG. 3A is a schematic diagram illustrating a device 300 for coupling an antenna with a receiver and a transmitter in accordance with some embodiments.

The device 300 is similar to the device 100 illustrated in FIG. 1 in that the device 300 includes a first isolator 304, a first filter 306, a first circulator 308, a second filter 310, and a second isolator 312. The device 300 also includes a first waveguide port 302 configured for coupling with a first transmitter, a second waveguide port 314 configured for coupling with a first receiver, and a third waveguide port 316 configured for coupling with a first antenna. In some embodiments, the device 300 includes only a subset of the first waveguide port 302, the second waveguide port 314, and the third waveguide port 316. For example, in some embodiments, the device 300 includes the first waveguide port 302 and the second waveguide port 314 without the third waveguide port 316. In some embodiments, the device 300 includes the third waveguide port 316 without the first waveguide port 302 and the second waveguide port 314.

Thus, the device 300 is capable of routing signals from the first transmitter to the first antenna and signals from the first antenna to the first receiver.

In some embodiments, the device 300 also includes a fourth waveguide port 318 configured for coupling with a second transmitter and a fifth waveguide port 320 configured for coupling with a second receiver. In such embodiments, the device 300 is also capable of mechanically coupling with the second transmitter and the second receiver.

FIG. 3B is a schematic diagram illustrating a device 340 for coupling two antennas with two receivers and a transmitter in accordance with some embodiments.

The device 340 is similar to the device 300 illustrated in FIG. 3A in that the device 340 includes the first waveguide port 302, the first isolator 304, the first filter 306, the first isolator 308, the second filter 310, the second isolator 312, the second waveguide port 314, the third waveguide port 316, the fourth waveguide port 318, and the fifth waveguide port 320. The device 340 also includes a sixth waveguide port 328 configured for coupling with a second antenna that is distinct from the first antenna. The device 340 further includes a second circulator 326, a filter 330, and an isolator 332.

Thus, the device 340 is capable of routing signals from the first transmitter to the first antenna, signals from the first antenna to the first receiver, and signals from the second antenna to the second receiver.

FIG. 3C is a schematic diagram illustrating a device 380 for coupling two antennas with two receivers and two transmitters in accordance with some embodiments.

The device 380 is similar to the device 340 illustrated in FIG. 3B in that the device 380 includes the first waveguide port 302, the first isolator 304, the first filter 306, the first isolator 308, the second filter 310, the second isolator 312, the second waveguide port 314, the third waveguide port 316, the fourth waveguide port 318, the fifth waveguide port 320, the sixth waveguide port 328, the second isolator 326, the filter 330 (also called herein a fourth filter), and the isolator 332 (also called herein a fourth isolator). The device 380 also includes a third isolator 322 and a third filter 324.

Thus, as shown in FIG. 3C, in some embodiments, the device 380 includes a third isolator 322 that includes an input port (i) and an output port (o) that is distinct from the input port (i). The third isolator 322 is distinct from the first isolator 304 and the second isolator 312. In some embodiments, the third isolator 322 is configured to transmit radio-frequency or microwave signals received through the input port (i) of the third isolator 322 to the output port (o) of the third isolator 322. In some embodiments, the third isolator 322 is configured to suppress radio-frequency or microwave signals received through the output port (o) of the third isolator 322 from being output through the input port (i) of the third isolator 322.

The device 380 also includes a second circulator 326 that includes a first port (1), a second port (2) distinct from the first port (1), and a third port (3) distinct from the first port (1) and the second port (2). The second circulator 326 is distinct from the first circulator 308. The first port (1) of the second circulator 326 is coupled with the output port (o) of the third isolator 322. In some embodiments, the first port (1) of the second circulator 326 is directly coupled with the output port (o) of the first isolator 322. In some embodiments, the first port (1) of the second circulator 326 is coupled with the output port (o) of the first isolator 322 through one or more components (e.g., the third filter 324). The second port (2) of the second circulator 326 is configured for coupling with a second antenna. In some embodiments, the second circulator 326 is configured to route radio-frequency or microwave signals received through the first port (1) of the second circulator 326 to the second port (2) of the second circulator 326 and radio-frequency or microwave signals received through the second port (2) of the second circulator 326 to the third port (3) of the second circulator 326. In some embodiments, the second circulator 326 is configured to route radio-frequency or microwave signals received through the third port (3) of the second circulator 326 to the first port (1) of the second circulator 326.

The device 380 further includes a fourth isolator 332 that includes an input port (i) and an output port (o) that is distinct from the input port (i). The fourth isolator 332 is distinct from the first isolator 304, the second isolator 312, and the third isolator 322. The input port (i) of the fourth isolator 332 is coupled with the third port (3) of the second circulator 326. In some embodiments, the fourth isolator 332 is configured to transmit radio-frequency or microwave signals received through the input port (i) of the fourth isolator 332 to the output port (o) of the fourth isolator 332. In some embodiments, the fourth isolator 332 is configured to suppress radio-frequency or microwave signals received through the output port (o) of the fourth isolator 332 from being output through the input port (i) of the fourth isolator 332.

In some embodiments, the output port (o) of the fourth isolator 332 is configured to couple with an input port (i) of a second radio-frequency or microwave receiver (e.g., through the fifth waveguide port 320).

In some embodiments, the input port (i) of the third isolator 322 is configured to couple with an output port (o) of a second radio-frequency or microwave transmitter (e.g., through the fourth waveguide port 318).

Although the device 380 illustrated in FIG. 3C is configured for coupling with two transmitters and two receivers, the device 380 can be operated without coupling with two transmitters and two receivers. For example, in some embodiments, while the device 380 is coupled with the first transmitter, the first receiver, and the second receiver without the second transmitter, the device 380 operates similar to the device 340 illustrated in FIG. 3B. Similarly, while the device 380 is coupled with the first transmitter and the first receiver without the second receiver and the second transmitter, the device 380 operates similar to the device 300 illustrated in FIG. 3A.

In some embodiments, the device 380 includes a third filter 324 that includes an input port (i) and an output port (o) that is distinct from the input port (i). The third filter 324 is distinct from the first filter 306 and the second filter 310. In some embodiments, the third filter 324 is configured to output radio-frequency or microwave signals that satisfy a third predetermined radio-frequency or microwave band, within radio-frequency or microwave signals received through the input port (i) of the third filter 324, through the output port (o) of the third filter 324. The third filter 324 is configured to suppress radio-frequency or microwave signals that do not satisfy the third predetermined radio-frequency or microwave band, within radio-frequency or microwave signals received through the input port (i) of the third filter 324, from being output through the output port (o) of the third filter 324. In some embodiments, the third predetermined radio-frequency or microwave band is distinct from the first predetermined radio-frequency or microwave band. In some embodiments, the third predetermined radio-frequency or microwave band does not overlap with the first predetermined radio-frequency or microwave band. In some embodiments, the third predetermined radio-frequency or microwave band is distinct from the second predetermined radio-frequency or microwave band. In some embodiments, the third predetermined radio-frequency or microwave band does not overlap with the second predetermined radio-frequency or microwave band.

In some embodiments, the input port (i) of the third filter 324 is coupled with the output port (o) of the third isolator 322 and the output port (o) of the third filter 324 is coupled with the first port (1) of the second circulator 326 so that the first port (1) of the second circulator 326 is coupled with the output port (o) of the third isolator 322 through the third filter 324. In some embodiments, the first port (1) of the second circulator 326 is directly coupled with the output port (o) of the third isolator 322 (e.g., the third filter 324 is not located between the second circulator 326 and the third isolator 322).

In some embodiments, the third filter 324 is a tunable filter and the third predetermined radio-frequency or microwave band is tunable.

In some embodiments, the device 380 includes a fourth filter 330 that includes an input port (i) and an output port (o) that is distinct from the input port (i). The fourth filter 330 is distinct from the first filter 306, the second filter 310, and the third filter 324. The fourth filter 330 is configured to output radio-frequency or microwave signals that satisfy a fourth predetermined radio-frequency or microwave band, within radio-frequency or microwave signals received through the input port (i) of the fourth filter 330, through the output port (o) of the fourth filter 330. The fourth filter 330 is configured to suppress radio-frequency or microwave signals that do not satisfy the fourth predetermined radio-frequency or microwave band, within radio-frequency or microwave signals received through the input port (i) of the fourth filter 330, from being output through the output port (o) of the fourth filter 330. In some embodiments, the fourth predetermined radio-frequency or microwave band is distinct from the third predetermined radio-frequency or microwave band. In some embodiments, the fourth predetermined radio-frequency or microwave band does not overlap with the third predetermined radio-frequency or microwave band. In some embodiments, the fourth predetermined radio-frequency or microwave band is distinct from the second predetermined radio-frequency or microwave band. In some embodiments, the fourth predetermined radio-frequency or microwave band does not overlap with the second predetermined radio-frequency or microwave band. In some embodiments, the fourth predetermined radio-frequency or microwave band is distinct from the first predetermined radio-frequency or microwave band. In some embodiments, the fourth predetermined radio-frequency or microwave band does not overlap with the first predetermined radio-frequency or microwave band.

In some embodiments, the input port (i) of the fourth filter 330 is coupled with the third port (3) of the second circulator 326 and the output port (o) of the fourth filter 330 is coupled with the input port (i) of the fourth isolator 332 so that the third port (3) of the second circulator 326 is coupled with the input port (i) of the fourth isolator 332 through the fourth filter 330. In some embodiments, the third port (3) of the second circulator 326 is directly coupled with the input port (i) of the fourth isolator 332 (e.g., the fourth filter 330 is not located between the second circulator 326 and the fourth isolator 332).

In some embodiments, the fourth filter 330 is a tunable filter and the fourth predetermined radio-frequency or microwave band is tunable.

In some embodiments, the first isolator 304, the first circulator 308, the second isolator 312, the third isolator 322, the second circulator 326, and the fourth isolator 332 are formed using a single plate (e.g., a circulator plate described below with respect to FIGS. 4A-4C).

In some embodiments, each isolator is a circulator that includes a first port, a second port distinct from the first port, and a third port distinct from the first port and the second port. Only one of the first port, the second port, and the third port is terminated with a matched load.

Figure 4A:
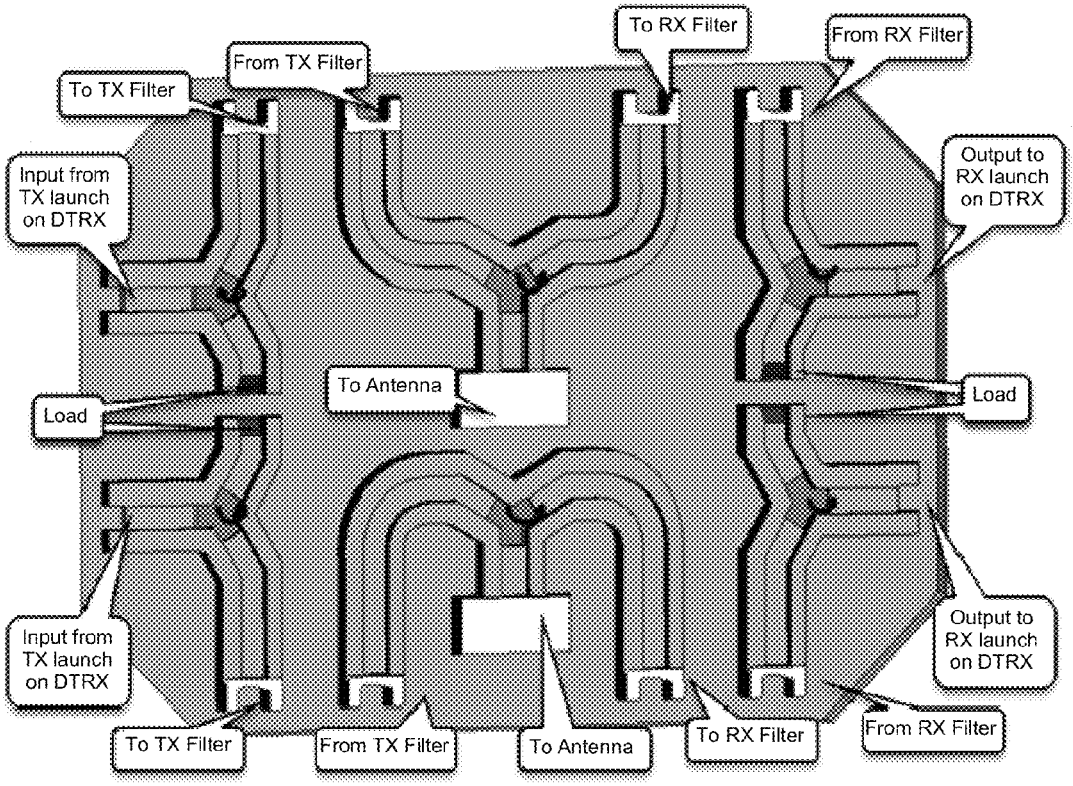
FIG. 4A is a top view of a circulator plate in accordance with some embodiments.
Figure 4B:
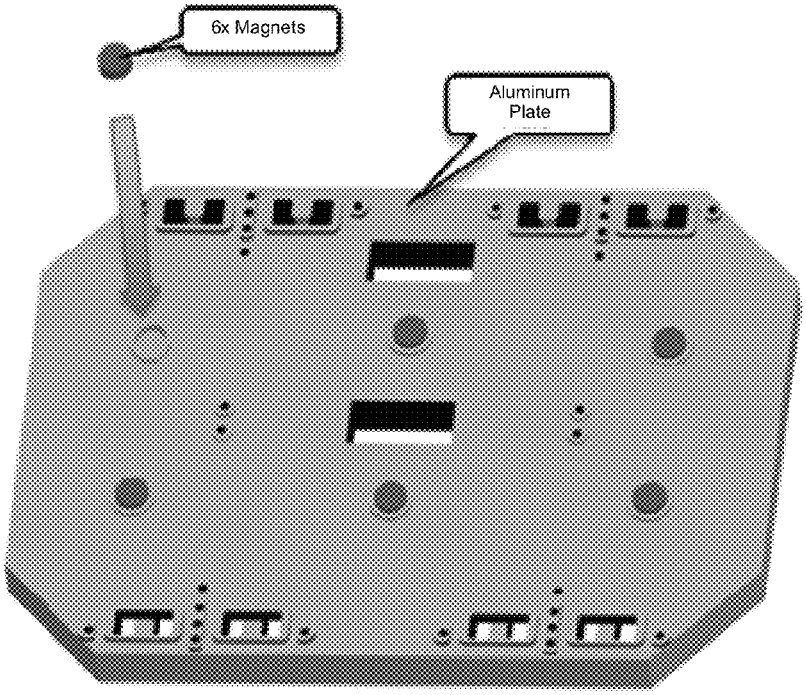
FIGS. 4B-4C are exploded views of a circular plate in accordance with some embodiments.
Figure 4C:
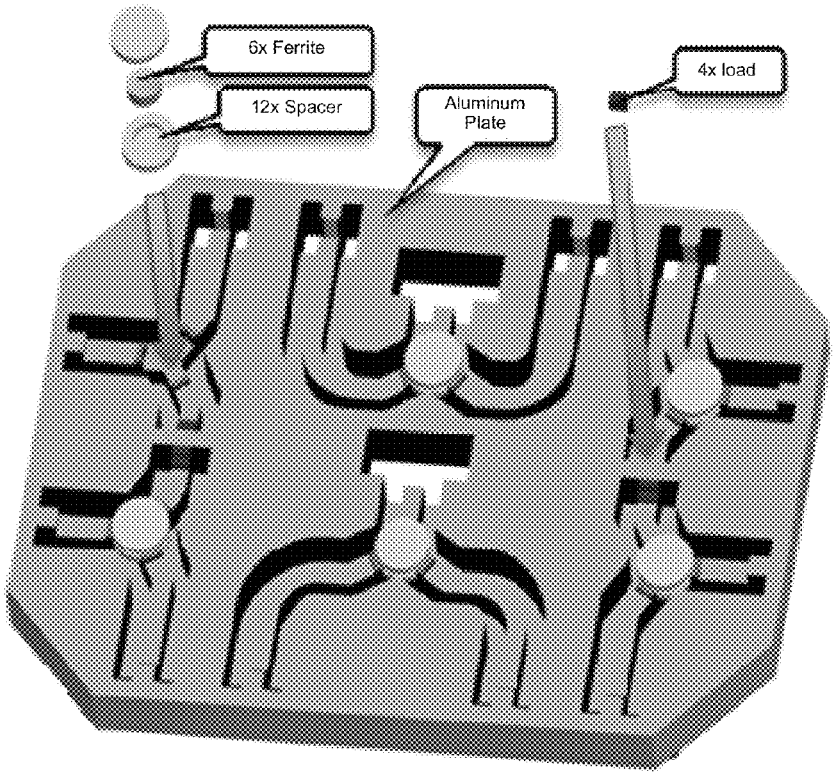

FIGS. 4A-4C illustrate a circulator plate in accordance with some embodiments.

FIG. 4A is a top view of a circulator plate in accordance with some embodiments. In some embodiments, the circulator plate is made of a conductive material (e.g., aluminum) or a conductively plated material. Multiple waveguides are formed within the circulator plate. As illustrated in FIG. 4A, six Y channels are formed within the circulator plate. Each of four Y channels of the six Y channels has a terminated with a matched load end so that the Y channel operates as an isolator. Each of the remaining two Y channels operates as a circulator.

In some embodiments, multiple holes are defined within the circulator plates to couple with other components (e.g., filters and antennas).

FIGS. 4B-4C are exploded views of a circular plate in accordance with some embodiments. FIGS. 4B-4C illustrate that a ferrite is located at a junction of each Y channel on one side of the circulator plate and a magnet is located at a corresponding location on the other side of the circulator plate (e.g., the opposite side of the junction of each Y channel). The magnetic field formed by the magnet and the ferrite and applied on a Y channel renders the Y channel to operate as a circulator. When one end of the Y channel is terminated with a matched load, the Y channel operates as an isolator. In some embodiments, the circulator plate includes one or more spacers for placing the ferrite at a junction of each Y channel.

Figure 4D:
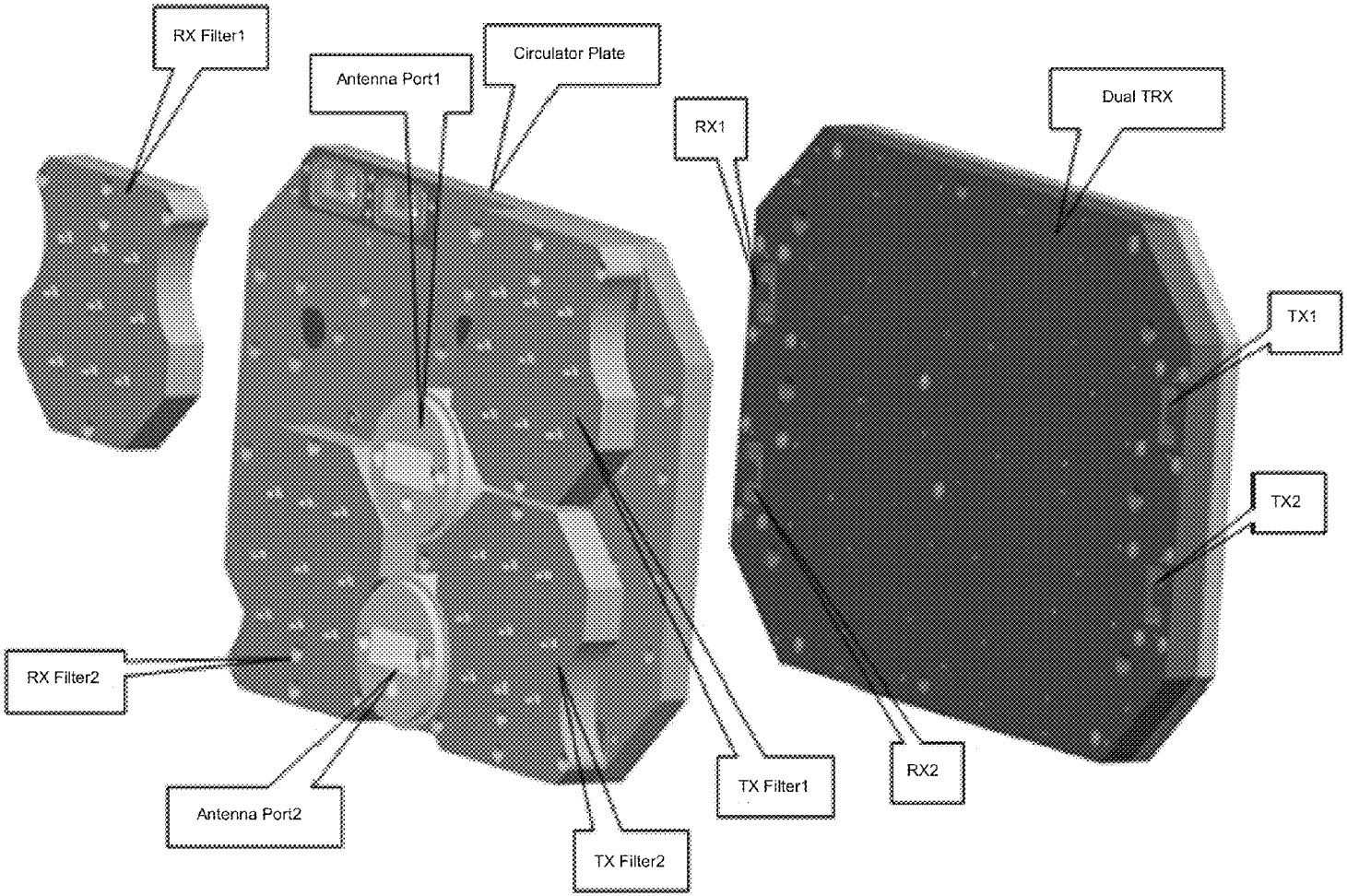
FIG. 4D is an exploded view of a dual-radio-channel system with a circulator plate and filters in accordance with some embodiments.

FIG. 4D is an exploded view of a dual-radio-channel system in accordance with some embodiments.

The dual-radio-channel system includes the circulator plate illustrated in FIGS. 4A-4C.

On one side of the circulator plate, the circulator plate is coupled with two receiver filters and two transmitter filters. As shown in FIG. 4D, each of the receiver filters and the transmitter filters is a modular filter, which is coupled releasably with the circulator plate. The dual-radio-channel system also includes one or more antenna ports, which are coupled releasably with the circulator plate.

On the opposite side of the circulator plate, the circulator plate is coupled with a dual transmitter-receiver module, which includes two transmitters and two receivers. The dual transmitter-receiver module has four connectors: a first connector for a first transmitter, a second connector for a first receiver, a third connector for a second transmitter, and a fourth connector for a second receiver. The dual transmitter-receiver module coupled with the circulator plate by mating each of the four connectors with a respective isolator in the circulator plate.

Figure 4E:
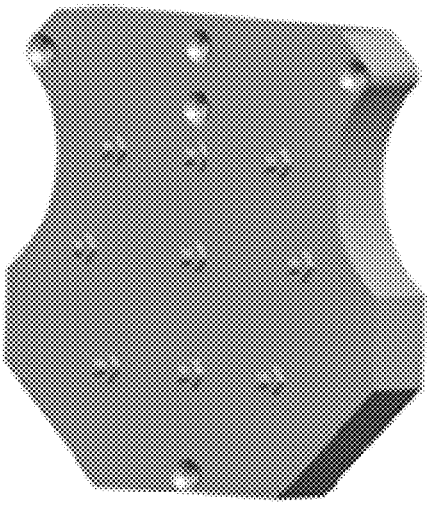
FIGS. 4E and 4F are perspective views of a filter module in accordance with some embodiments.
Figure 4F:
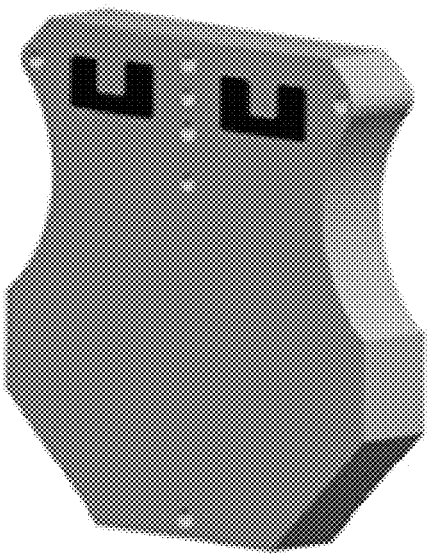

FIGS. 4E and 4F are perspective views of a filter module in accordance with some embodiments.

Filters are typically designed based on a size and shape of a corresponding cavity (e.g., the waveguide). The filter module illustrated in FIGS. 4E and 4F has a shape of a typical filter used for low frequency bands. Filters used for high frequency bands are typically smaller.

Figure 5A:
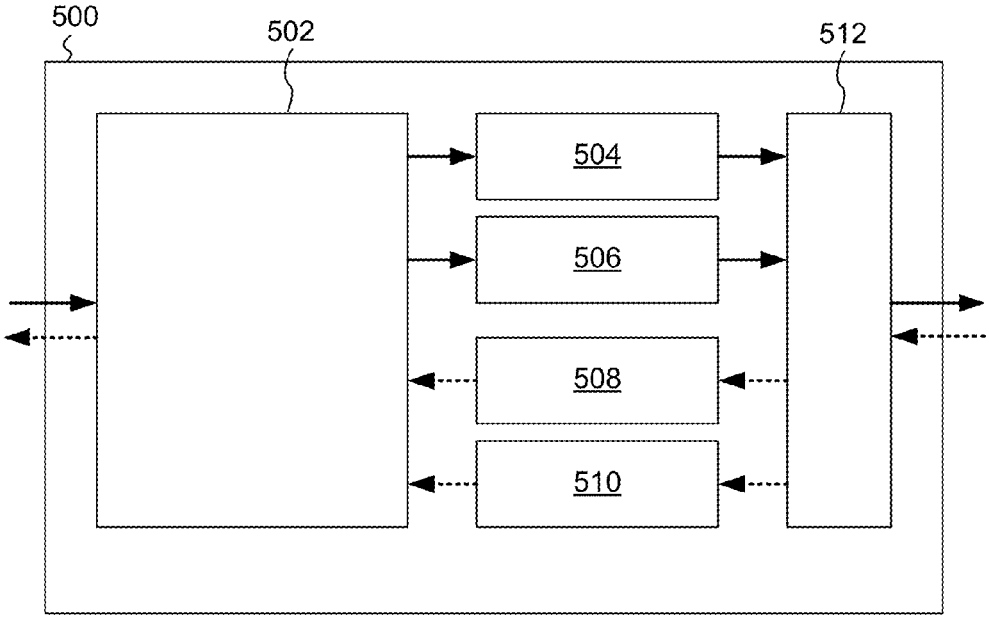
FIG. 5A is a schematic diagram illustrating a dual-radio-channel system in accordance with some embodiments.

FIG. 5A is a schematic diagram illustrating a dual-radio-channel system 500 in accordance with some embodiments.

The dual-radio-channel system 500 includes a first transmitter 504, a second transmitter 506, a first receiver 508, and a second receiver 510. In some embodiments, the first transmitter 504 and the second transmitter 506 have identical performances (e.g., same parts) but the first transmitter 504 is distinct and separate from the second transmitter 506. Similarly, in some embodiments, the first receiver 508 and the second receiver 510 have identical performances (e.g., same parts) but the first receiver 508 is distinct and separate from the second receiver 506. The dual-radio-channel system 500 also includes an antenna coupling device 512, which routes signals between one or more antennas, the first transmitter 504, the second transmitter 506, the first receiver 508, and the second receiver 510. Exemplary antenna coupling devices 512 are described above with respect to FIGS. 1 and 3A-3C.

In some embodiments, the dual-radio-channel system 500 also includes a digital board 502, which houses Ethernet and modem circuitries. The digital board routes Ethernet input signals to first and second modems through a Physical Layer Aggregation (PLA) block. In some embodiments, an output of a modem is connected to a transmitter (e.g., 504), which converts baseband signals into intermediate frequency (IF) signals, and then converts the IF signals to radio-frequency (RF) signals. In some embodiments, the dual-radio-channel system 500 includes a power amplifier that is used in the transmitter (e.g., 504) to amplify the RF signals to a level suitable for connection to an antenna through the antenna coupling device 512. In some embodiments, the dual-radio-channel system 500 includes a low-noise amplifier. In the receiver direction, the received signals are passed through the low-noise amplifier, and down-converted to IF signals before going through multi-stage automatic gain control circuits to provide constant IF signals to the modem. The outputs of the two modems are routed to the PLA block, which consolidates the two modem signals into Ethernet signal streams.

Figure 5B:
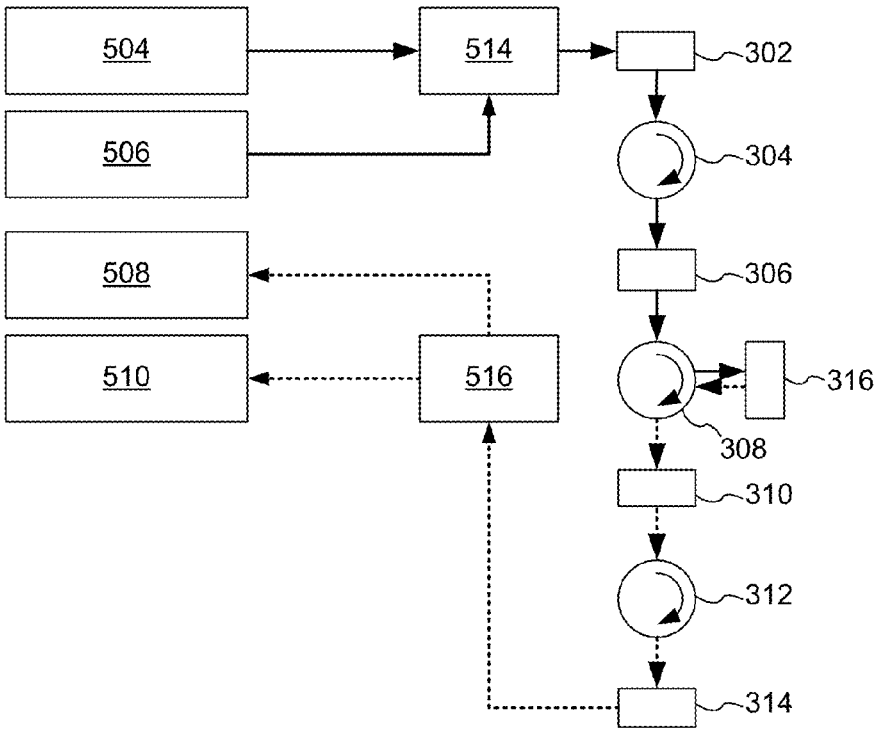
FIG. 5B is a schematic diagram illustrating a dual-radio-channel system in a 1+1 Hot Standby (HSB)/Non-Space Diversity configuration in accordance with some embodiments.

FIG. 5B is a schematic diagram illustrating a dual-radio-channel system in a 1+1 Hot Standby (HSB)/Non-Space Diversity configuration in accordance with some embodiments.

In FIG. 5B, transmission signals output from the first transmitter 504 and the second transmitter 506 are sent to a radio frequency (RF) combiner 514. The RF combiner 514 receives the transmission signals from the first transmitter 504 and the second transmitter 506 and routes the transmission signals to the first isolator 304. In some embodiments, the RF combiner 514 routes the transmission signals to the first isolator 304 through the first waveguide port 302. The transmission signals pass through the first isolator 304 and the first filter 306 and propagate toward the first circulator 308. The first circulator 308 receives the transmission signals and routes the transmission signals toward a first antenna. In some embodiments, the first circulator 308 routes the transmission signals toward the first antenna through the third waveguide port 316.

In comparison, reception signals received by the first antenna are routed to the first circulator 308. In some embodiments, the reception signals received by the first antenna are routed to the first circulator 308 through the third waveguide port 316. The first circulator 308 receives the reception signals and routes the reception signals toward the second filter 310. The reception signals pass through the second filter 310 and the second isolator 312, and propagate toward a splitter 516. In some embodiments, the reception signals propagate toward the splitter 516 through the second waveguide port 314. The splitter 516 splits the reception signals and sends a portion of the reception signals to the first receiver 508 and another portion of the reception signals to the second receiver 510.

In some embodiments, the first waveguide port 302, the first isolator 304, the first filter 306, the first circulator 308, the second filter 310, the second isolator 312, the second waveguide port 314, the combiner 514, and the splitter 516 collectively correspond to an antenna coupling device (e.g., the antenna coupling device 512). In some embodiments, the antenna coupling device includes the first waveguide port 302, the first isolator 304, the first filter 306, the first circulator 308, the second filter 310, the second isolator 312, the second waveguide port 314, the combiner 514, and the splitter 516 or a subset or a superset thereof. Similarly, in FIGS. 5C-5F, all or a subset of the components except for the transmitters and receivers (e.g., transmitters 504 and 506 and receivers 508 and 510) can be implemented in an antenna coupling device. For brevity, these details are not repeated herein.

Figure 5C:
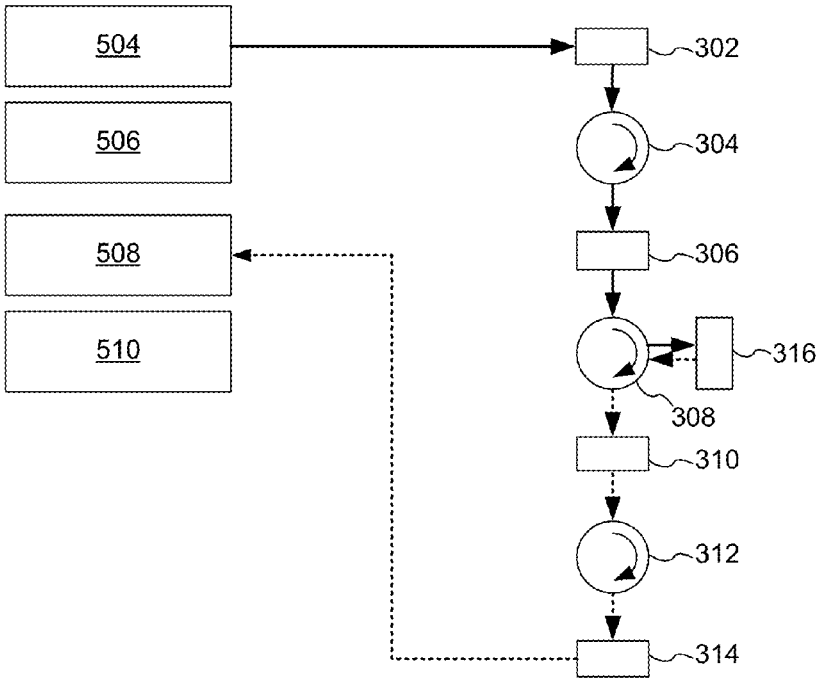
FIG. 5C is a schematic diagram illustrating a dual-radio-channel system in a 1+0 Non-Protected configuration in accordance with some embodiments.

FIG. 5C is a schematic diagram illustrating a dual-radio-channel system in a 1+0 Non-Protected configuration in accordance with some embodiments.

In FIG. 5C, transmission signals output from the first transmitter 504 are sent to the first isolator 304. In some embodiments, the transmission signals are sent to the first isolator 304 through the first waveguide port 302. The transmission signals pass through the first isolator 304 and the first filter 306 and propagate toward the first circulator 308. The first circulator 308 receives the transmission signals and routes the transmission signals toward a first antenna. In some embodiments, the first circulator 308 routes the transmission signals toward the first antenna through the third waveguide port 316.

In comparison, reception signals received by the first antenna are routed to the first circulator 308. In some embodiments, the reception signals received by the first antenna are routed to the first circulator 308 through the third waveguide port 316. The first circulator 308 receives the reception signals and routes the reception signals toward the second filter 310. The reception signals pass through the second filter 310 and the second isolator 312, and propagate to the first receiver 508.

Figure 5D:
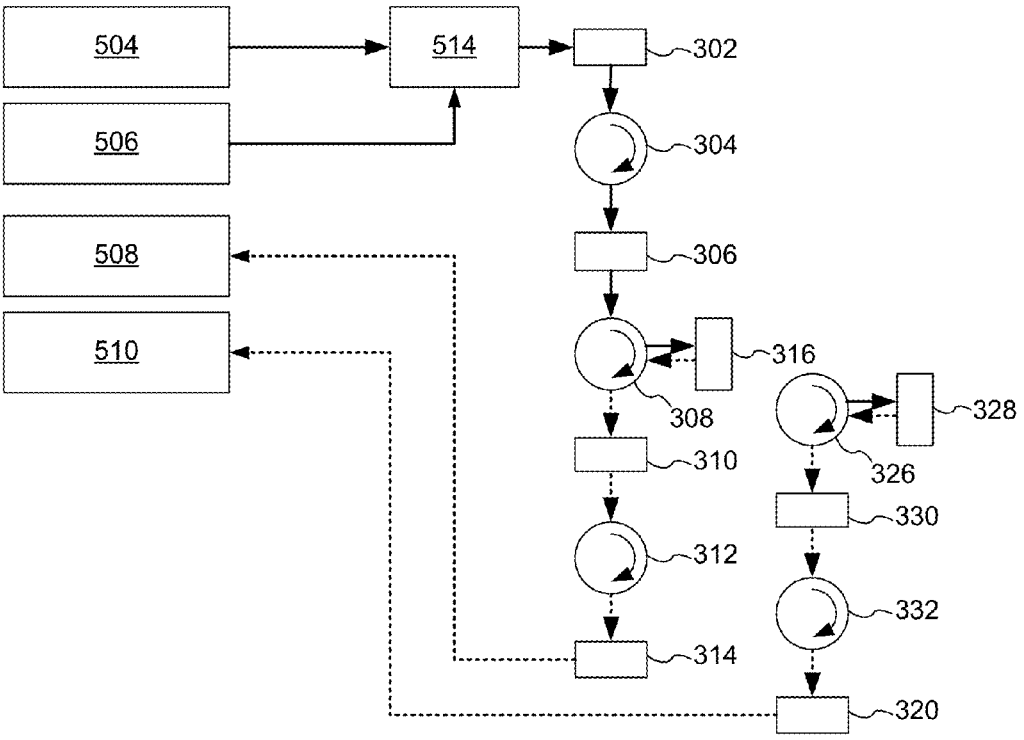
FIG. 5D is a schematic diagram illustrating a dual-radio-channel system in a 1+1 HSB/Space Diversity configuration in accordance with some embodiments.

FIG. 5D is a schematic diagram illustrating a dual-radio-channel system in a 1+1 HSB/Space Diversity configuration in accordance with some embodiments.

In FIG. 5D, the signal paths from the first transmitter 504 and the second transmitter 506 to the first antenna are identical to the paths described above with respect to FIG. 5B. For brevity, these details are not repeated herein.

The signal path from the first antenna to the first receiver 508 is identical to the path described above with respect to FIG. 5C. For brevity, these details are not repeated herein.

Reception signals received by the second antenna are routed to the second circulator 326. In some embodiments, the reception signals are routed to the second circulator 326 through the sixth waveguide port 328. The second circulator 326 receives the reception signals and routes the reception signals toward the fourth filter 330. The reception signals pass through the fourth filter 330 and the fourth isolator 332, and propagate to the second receiver 510. In some embodiments, the reception signals propagate to the second receiver 510 through the fifth waveguide port 320.

Thus, reception signals received by the first antenna and reception signals received by the second antenna are processed separately, thereby enabling the dual-radio-channel system for use in a space diversity configuration.

Figure 5E:
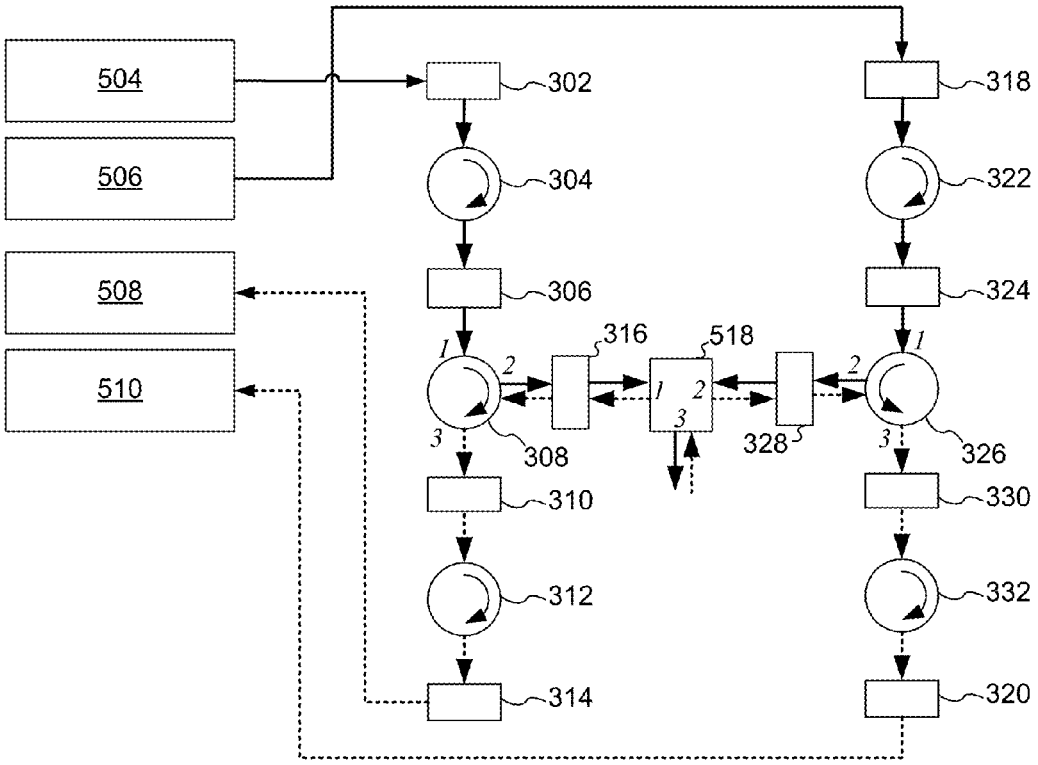
FIG. 5E is a schematic diagram illustrating a dual-radio-channel system in a 2+0 orthogonal polarization (XPIC)/PLA configuration in accordance with some embodiments.

FIG. 5E is a schematic diagram illustrating a dual-radio-channel system in a 2+0 XPIC/PLA configuration in accordance with some embodiments.

In FIG. 5E, the signal path from the first transmitter 504 to the third waveguide port 316 and the signal path from the third waveguide port 316 to the first receiver 508 are identical to the signal paths described above with respect to FIG. 5C. For brevity, these details are not repeated herein. The transmission signals sent to the third waveguide port 316 propagate toward an orthomode transducer 518. In some embodiments, the transmission signals sent from the first transmitter 504 have a first polarization. In some embodiments, the reception signals received by the first receiver 508 have a first polarization.

The transmission signals from the second transmitter 506 are sent to the third isolator 322. In some embodiments, the transmission signals from the second transmitter 506 are sent to the third isolator 322 through the fourth waveguide port 318. The transmission signals pass through the third isolator 322 and the third filter 324 and propagate toward the second circulator 326. The second circulator 326 receives the transmission signals and routes the transmission signals toward the orthomode transducer 518. In some embodiments, the second circulator 326 routes the transmission signals toward the orthomode transducer 518 through the sixth waveguide port 328. In some embodiments, the transmission signals sent from the second transmitter 506 have a second polarization that is orthogonal to the first polarization.

Reception signals received by the orthomode transducer 518 are routed to the first circulator 308 and the second circulator 326. The second circulator 326 receives the reception signals and routes the reception signals toward the fourth filter 330. The reception signals pass through the fourth filter 330 and the fourth isolator 332, and propagate to the second receiver 510. In some embodiments, the reception signals propagate to the second receiver 510 through the fifth waveguide port 320. In some embodiments, the reception signals received by the second receiver 510 have the second polarization.

In some embodiments, the device (e.g., the dual-radio-channel system) includes an orthomode transducer 518 that includes a first port (1) configured for transmitting radio-frequency or microwave signals that have a first linear polarization, a second port (2) configured for transmitting radio-frequency or microwave signals that have a second linear polarization orthogonal to the first linear polarization, and a third port (3) configured for transmitting radio-frequency or microwave signals that have the first linear polarization and radio-frequency or microwave signals that have the second linear polarization. For example, the radio-frequency or microwave signals received by the orthomode transducer 518 through the first port 1 and/or the second port 2 are output through the third port 3 toward an antenna. The second port (2) of the first circulator 308 is coupled with the first port (1) of the orthomode transducer 518. The second port (2) of the second circulator 326 is coupled with the second port (2) of the orthomode transducer 518.

Figure 5F:
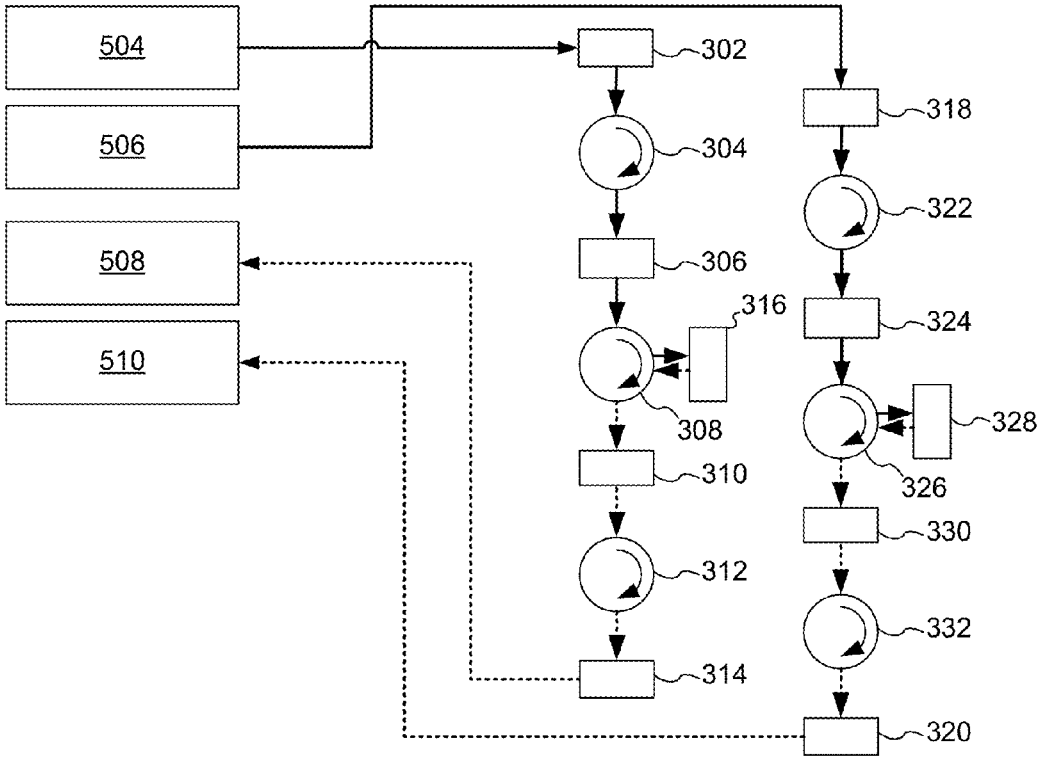
FIG. 5F is a schematic diagram illustrating a dual-radio-channel system in a 1+0 Add/Drop or PassThru Repeater configuration in accordance with some embodiments.

FIG. 5F is a schematic diagram illustrating a dual-radio-channel system in a 1+0 Add/Drop or PassThru Repeater configuration in accordance with some embodiments.

In FIG. 5F, the signal path from the first transmitter 504 to the third waveguide port 316 and the signal path from the third waveguide port 316 to the first receiver 508 are identical to the signal paths described above with respect to FIG. 5C. For brevity, these details are not repeated herein.

The transmission signals from the second transmitter 506 are sent to the third isolator 322. In some embodiments, the transmission signals from the second transmitter 506 are sent to the third isolator 322 through the fourth waveguide port 318. The transmission signals pass through the third isolator 322 and the third filter 324 and propagate toward the second circulator 326. The second circulator 326 receives the transmission signals and routes the transmission signals toward a second antenna. In some embodiments, the second circulator 326 routs the transmission signals toward the second antenna through the sixth waveguide port 328.

Reception signals received by the second antenna are routed to the second circulator 326. In some embodiments, the reception signals received by the second antenna are routed to the second circulator 326 through the sixth waveguide port 328. The second circulator 326 receives the reception signals and routes the reception signals toward the fourth filter 330. The reception signals pass through the fourth filter 330 and the fourth isolator 332, and propagate to the second receiver 510. In some embodiments, the reception signals propagate to the second receiver 510 through the fifth waveguide port 320.

Figure 6A:
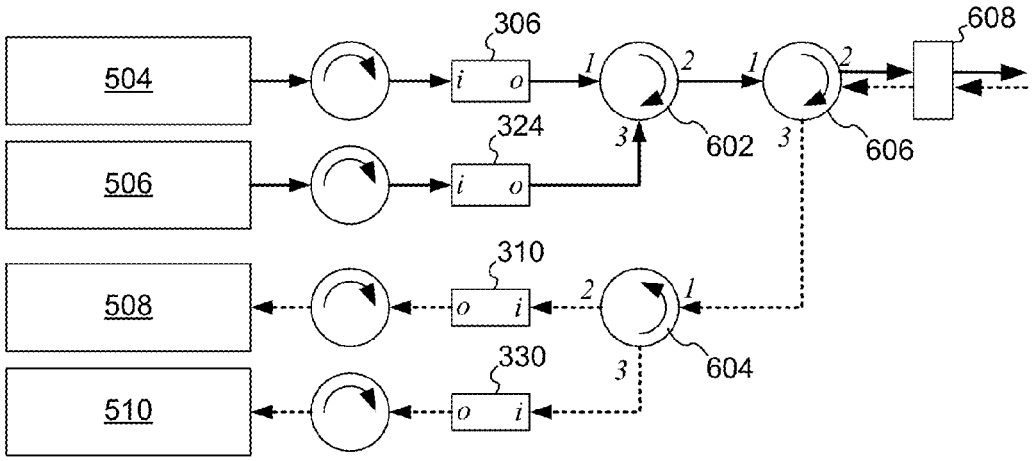
FIG. 6A is a schematic diagram illustrating a dual-radio-channel system in a 1+1 Frequency Diversity/2+0 PLA configuration in accordance with some embodiments.

FIG. 6A is a schematic diagram illustrating a dual-radio-channel system in a 2+0 Frequency Diversity/2+0 PLA configuration in accordance with some embodiments.

The system includes a first receiver filter 310 that includes an input port (i) and an output port (o) that is distinct from the input port (i). The first receiver filter 310 is configured to transmit radio-frequency or microwave signals that satisfy a first predetermined receiver radio-frequency or microwave band, within radio-frequency or microwave signals received through the input port (i) of the first receiver filter 310, through the output port (o) of the first receiver filter 310. The first receiver filter 310 is configured to send back (e.g., by reflection) radio-frequency or microwave signals that do not satisfy the first predetermined receiver radio-frequency or microwave band, within radio-frequency or microwave signals received through the input port (i) of the first receiver filter 310, through the input port (i) of the first receiver filter 310. For example, the first receiver filter 310 operates as a reflector for radio-frequency or microwave signals that do not satisfy the first predetermined receiver radio-frequency or microwave band.

The system includes a second receiver filter 330 that includes an input port (i) and an output port (o) that is distinct from the input port (i). The second receiver filter 330 is distinct from the first receiver filter 310. The second receiver filter 330 is configured to transmit radio-frequency or microwave signals that satisfy a second predetermined receiver radio-frequency or microwave band, within radio-frequency or microwave signals received through the input port (i) of the second receiver filter 330, through the output port (o) of the second receiver filter 330. The second receiver filter 330 is configured to send back (e.g., by reflection) radio-frequency or microwave signals that do not satisfy the second predetermined receiver radio-frequency or microwave band, within radio-frequency or microwave signals received through the input port (i) of the second receiver filter 330, through the input port (i) of the second receiver filter 330.

The system includes a first transmitter filter 306 that includes an input port (i) and an output port (o) that is distinct from the input port (i). The first transmitter filter 306 is configured to transmit radio-frequency or microwave signals that satisfy a first predetermined transmitter radio-frequency or microwave band, within radio-frequency or microwave signals received through the input port (i) of the first transmitter filter 306, through the output port (o) of the first transmitter filter 306. The first transmitter filter 306 is configured to suppress radio-frequency or microwave signals that do not satisfy the first predetermined transmitter radio-frequency or microwave band, within radio-frequency or microwave signals received through the input port (i) of the first transmitter filter 306, from being output through the output port (o) of the first transmitter filter 306.

The system includes a second transmitter filter 324 that includes an input port (i) and an output port (o) that is distinct from the input port (i). The second transmitter filter 324 is distinct from the first transmitter filter 306. The second transmitter filter 324 is configured to transmit radio-frequency or microwave signals that satisfy a second predetermined transmitter radio-frequency or microwave band, within radio-frequency or microwave signals received through the input port (i) of the second transmitter filter 324, through the output port (o) of the second transmitter filter 324. The second transmitter filter 324 is configured to suppress radio-frequency or microwave signals that do not satisfy the second predetermined transmitter radio-frequency or microwave band, within radio-frequency or microwave signals received through the input port (i) of the second transmitter filter, from being output through the output port (o) of the second transmitter filter 324.

The system includes a first circulator 602 that includes a first port (1), a second port (2), and a third port (3). The second port (2) is distinct from the first port (1). The third port (3) is distinct from the first port (1) and the second port (2). The first port (1) of the first circulator 602 is coupled with the output port (o) of the first transmitter filter 306. The third port (3) of the first circulator 602 is coupled with the output port (o) of the second transmitter filter 324.

The system includes a second circulator 604 that includes a first port (1), a second port (2), and a third port. The second port (2) is distinct from the first port (1). The third port (3) is distinct from the first port (1) and the second port (2). The second circulator 604 is distinct from the first circulator 602. The second port (2) of the second circulator 604 is coupled with the input port (i) of the first receiver filter 310. The third port (3) of the second circulator 604 is coupled with the input port (i) of the second receiver filter 330.

The system includes a third circulator 606 that includes a first port (1), a second port (2), and a third port (3). The second port (2) is distinct from the first port (1). The third port (3) is distinct from the first port (1) and the second port (2). The third circulator 606 is distinct from the first circulator 602 and the second circulator 604.

The first port (1) of the third circulator 606 is coupled with the second port (2) of the first circulator 602. The third port (3) of the third circulator 606 is coupled with the first port (1) of the second circulator 604.

The third circulator 606 is configured to route radio-frequency or microwave signals received through the first port (1) of the third circulator 606 to the second port (2) of the third circulator 606 and route radio-frequency or microwave signals received through the second port (2) of the third circulator 606 to the third port (3) of the third circulator 606. In some embodiments, the third circulator 606 is configured to route radio-frequency or microwave signals received through the third port (3) of the third circulator 606 to the first port (1) of the third circulator 606.

In some embodiments, the second port (2) of the third circulator 606 is configured for coupling with an antenna (e.g., through a waveguide port 608). In some embodiments, the signals output through the second port (2) of the third circulator 606 are sent to an antenna through the waveguide port 608.

In some embodiments, the first circulator 602 is configured to route radio-frequency or microwave signals received through the first port (1) of the first circulator 602 to the second port (2) of the first circulator 602 and route radio-frequency or microwave signals received through the third port (3) of the first circulator 602 to the first port (1) of the first circulator 602. For example, transmission signals from the first transmitter 504 are routed through the first transmitter filter 306 and the first circulator 602 to the third circulator 606. Transmission signals from the second transmitter 506 are transmitted through the second transmitter filter 324 to the third port (3) of the first circulator 602 and output through the first port (1) of the first circulator 602. The transmission signals from the first port (1) of the first circulator 602 are reflected by the first transmitter filter 306 and sent back to the first port (1) of the first isolator 602. The reflected transmission signals are received through the first port (1) of the first circulator 602 and output through the second port (2) of the first circulator 602, toward the first port (1) of the third circulator 606.

In some embodiments, the first circulator 602 is configured to route radio-frequency or microwave signals received through the first port (1) of the first circulator 602 to the third port (3) of the first circulator 602 and route radio-frequency or microwave signals received through the third port (3) of the first circulator 602 to the second port (2) of the first circulator 602.

In some embodiments, the second circulator 604 is configured to route radio-frequency or microwave signals received through the first port (1) of the second circulator 604 to the second port (2) of the second circulator 604 and route radio-frequency or microwave signals received through the second port (2) of the second circulator 604 to the third port (3) of the second circulator 604. For example, reception signals from the third circulator 606 are received through the first port (1) of the second circulator 604 and output through the second port (2) of the second circulator 604. The first receiver filter 310 receives the reception signals. Radio-frequency and microwave signals that satisfy the first predetermined receiver radio-frequency or microwave band, within the radio-frequency and microwave signals received through the input port (i) of the first receiver filter 310 are output through the output port (o) of the first receiver filter 310 and sent to the first receiver 508. Radio-frequency or microwave signals that do not satisfy the first predetermined receiver radio-frequency or microwave band are reflected by the first receiver filter 310 and sent back to the second circulator 604. The reflected reception signals are received through the second port (2) of the second circulator 604 and output through the third port (3) of the second circulator 604, toward the input port (i) of the second receiver filter 330. Radio-frequency or microwave signals that satisfy the second predetermined receiver radio-frequency or microwave band are output through the output port (o) of the second receiver filter 330 toward the second receiver 510.

In some embodiments, the second circulator 604 is configured to route radio-frequency or microwave signals received through the first port (1) of the second circulator 604 to the third port (3) of the second circulator 604 and route radio-frequency or microwave signals received through the third port (3) of the second circulator 604 to the second port (2) of the second circulator 604.

In some embodiments, the first transmitter filter 306, the second transmitter filter 324, the first receiver filter 310, the second receiver filter 330, the first circulator 602, the second circulator 604, the third circulator 606, and the waveguide port 608 collectively correspond to an antenna coupling device (e.g., the antenna coupling device 512). In some embodiments, the antenna coupling device includes the first transmitter filter 306, the second transmitter filter 324, the first receiver filter 310, the second receiver filter 330, the first circulator 602, the second circulator 604, the third circulator 606, and the waveguide port 608 or a subset or a superset thereof.

Figure 6B:
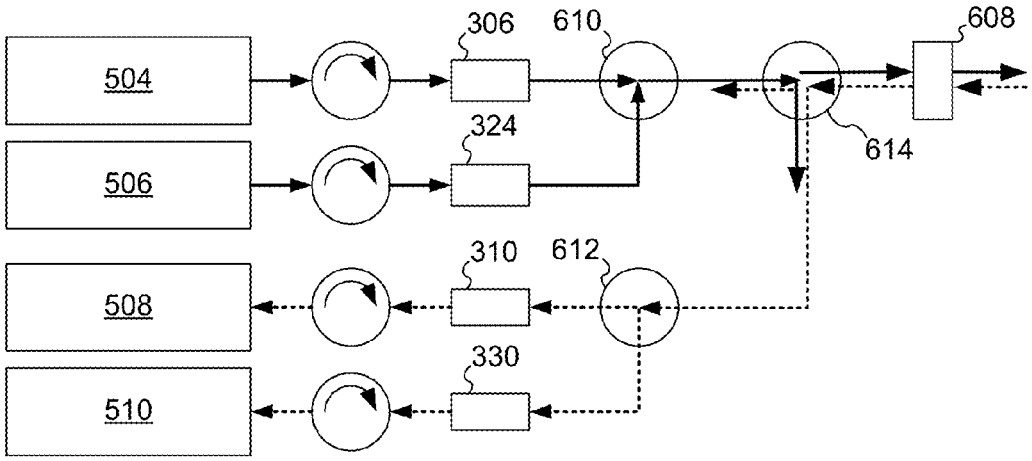
FIG. 6B is a schematic diagram illustrating a related device in a 1+1 Frequency Diversity/2+0 PLA configuration.

FIG. 6B is a schematic diagram illustrating a related system in a 2+0 Frequency Diversity/2+0 PLA configuration. The system illustrated in FIG. 6B is similar to the system illustrated in FIG. 6A except that the system illustrated in FIG. 6B includes T-junctions 610 and 612 and a splitter 614 instead of the circulators 602, 604, and 606 of the system illustrated in FIG. 6A.

As explained above with respect to FIG. 2, splitters are inefficient in transmitting signals. The loss of the system illustrated in FIG. 6B is typically 3 dB higher than the loss of the system illustrated in FIG. 6A. When the entire communication system is considered (both the transmitter side and the receiver side), the loss of the system illustrated in FIG. 6B is typically 6 dB higher than the loss of the system illustrated in FIG. 6A. Thus, the system illustrated in FIG. 6B requires a higher power transmitter and/or a more powerful amplifier, which are less desirable for making power efficient communication systems.

Referring back to FIG. 6A, in some embodiments, the system includes a first isolator that includes an input port (i) and an output port (o) that is distinct from the input port (i). The input port (i) of the first isolator is coupled with the output port (o) of the first receiver filter 310. The first isolator is configured to transmit radio-frequency or microwave signals received through the input port (i) of the first isolator to the output port (o) of the first isolator. The first isolator is configured to suppress radio-frequency or microwave signals received through the output port (o) of the first isolator from being output through the input port (i) of the first isolator. The system also includes a second isolator that includes an input port (i) and an output port (o) that is distinct from the input port (i). The second isolator is distinct from the first isolator. The input port (i) of the second isolator is coupled with the output port (o) of the second receiver filter 330. The second isolator is configured to transmit radio-frequency or microwave signals received through the input port (i) of the second isolator to the output port (o) of the second isolator. The second isolator is configured to suppress radio-frequency or microwave signals received through the output port (o) of the second isolator from being output through the input port (i) of the second isolator. The system further includes a third isolator that includes an input port (i) and an output port (o) that is distinct from the input port (i). The third isolator is distinct from the first isolator and the second isolator. The output port (o) of the third isolator is coupled with the input port (i) of the first transmitter filter 306. The third isolator is configured to transmit radio-frequency or microwave signals received through the input port (i) of the third isolator to the output port (o) of the third isolator. The third isolator is configured to suppress radio-frequency or microwave signals received through the output port (o) of the third isolator from being output through the input port (i) of the third isolator. The system includes a fourth isolator that includes an input port (i) and an output port (o) that is distinct from the input port (i). The fourth isolator is distinct from the first isolator, the second isolator, and the third isolator. The output port (o) of the fourth isolator is coupled with the input port (i) of the second transmitter filter 324. The fourth isolator is configured to transmit radio-frequency or microwave signals received through the input port (i) of the fourth isolator to the output port (o) of the fourth isolator. The fourth isolator is configured to suppress radio-frequency or microwave signals received through the output port (o) of the fourth isolator from being output through the input port (i) of the fourth isolator.

In some embodiments, each isolator is a circulator that includes a first port, a second port distinct from the first port, and a third port distinct from the first port and the second port, wherein only one of the first port, the second port, and the third port is terminated with a matched load. For example, FIGS. 4A-4C illustrate isolators that are formed each by terminating a port of a circulator with a matched load.

In some embodiments, the input port (i) of the first transmitter filter 306 is coupled with a first transmitter 504.

The input port (i) of the second transmitter filter 324 is coupled with a second transmitter 506. The output port (o) of the first receiver filter 310 is coupled with a first receiver 508. The output port (o) of the second receiver filter 330 is coupled with a second receiver 510.

In some embodiments, at least one of the first receiver filter 310, the second receiver filter 330, the first transmitter filter 306, and the second transmitter filter 324 is a tunable filter. In some embodiments, the tunable filter includes a printed circuit board motor.

In some embodiments, the first circulator 602, the second circulator 604, and the third circulator 606 are formed using a single plate.

In some embodiments, the first circulator 602 and the second circulator 604 are formed using a first plate and the third circulator 606 is formed using a second plate that is distinct from the first plate. In some embodiments, the first plate is configured to stack with the second plate so that the first circulator 602 and the second circulator 604 couple with the third circulator 606.

In some embodiments, all or a subset of the components illustrated in FIG. 6A except for the transmitters and receivers (e.g., transmitters 504 and 506 and receivers 508 and 510) are implemented in an antenna coupling device.

In accordance with some embodiments, a two-transmitter two-receiver wireless communication system includes a first receiver; a second receiver; a first transmitter; a second transmitter; and an antenna coupling device selected from a plurality of antenna coupling devices. The first receiver, the second receiver, the first transmitter, the second transmitter are configured for coupling with any antenna coupling device of the plurality of antenna coupling devices. Each antenna coupling device of the plurality of antenna coupling devices has an input waveguide port for coupling with the first receiver at a same first location and an output waveguide port for coupling with the first transmitter at a same second location. The first receiver, the second receiver, the first transmitter, the second transmitter are coupled with the antenna coupling device. In some embodiments, the plurality of antenna coupling devices includes any combination of antenna coupling devices described herein (e.g., FIGS. 3A-3C, 5B-5F, and 6A).

Figure 7A:
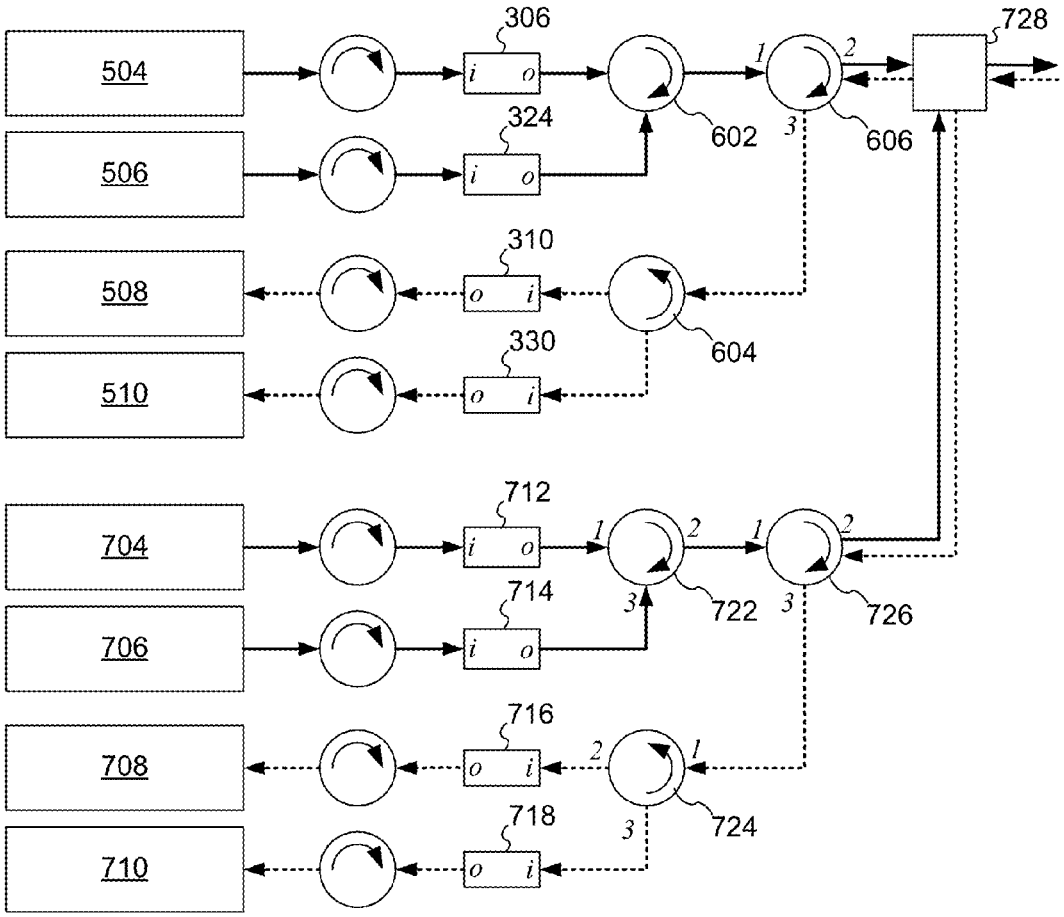
FIG. 7A is a schematic diagram illustrating a multi-radio-channel system in a 4+0 Frequency Diversity configuration in accordance with some embodiments.

FIG. 7A is a schematic diagram illustrating a multi-radio-channel system in a 4+0 Frequency Diversity configuration in accordance with some embodiments. The multi-radio-channel system in FIG. 7A includes two dual-radio-channel systems each having a structure analogous to the structure of the system illustrated in FIG. 6A. The two multi-radio channel systems are coupled with a same antenna using a splitter 728.

For example, an antenna coupling device includes the first receiver filter 310, the second receiver filter 330, the first transmitter filter 306, the second transmitter filter 324, the first circulator 602, the second circulator 604, and the third circulator 606.

The device also includes a third receiver filter 716 that includes an input port (i) and an output port (o) that is distinct from the input port (i). In some embodiments, the third receiver filter 716 is configured to transmit radio-frequency or microwave signals that satisfy a third predetermined receiver radio-frequency or microwave band, within radio-frequency or microwave signals received through the input port (i) of the third receiver filter 716, through the output port (o) of the third receiver filter 716. In some embodiments, the third receiver filter 716 is configured to send back radio-frequency or microwave signals that do not satisfy the third predetermined receiver radio-frequency or microwave band, within radio-frequency or microwave signals received through the input port (i) of the third receiver filter 716, through the input port (i) of the third receiver filter 716.

In some embodiments, the third predetermined receiver radio-frequency or microwave band is distinct from the first predetermined receiver radio-frequency or microwave band. In some embodiments, the third predetermined receiver radio-frequency or microwave band does not overlap with the first predetermined receiver radio-frequency or microwave band. In some embodiments, the third predetermined receiver radio-frequency or microwave band is distinct from the second predetermined receiver radio-frequency or microwave band. In some embodiments, the third predetermined receiver radio-frequency or microwave band does not overlap with the second predetermined receiver radio-frequency or microwave band.

The device includes a fourth receiver filter 718 that includes an input port (i) and an output port (o) that is distinct from the input port (i). The fourth receiver filter 718 is distinct from the third receiver filter 716. In some embodiments, the fourth receiver filter 718 is configured to transmit radio-frequency or microwave signals that satisfy a fourth predetermined receiver radio-frequency or microwave band, within radio-frequency or microwave signals received through the input port (i) of the fourth receiver filter 718, through the output port (o) of the fourth receiver filter 718. In some embodiments, the fourth receiver filter 718 is configured to reflect radio-frequency or microwave signals that do not satisfy the fourth predetermined receiver radio-frequency or microwave band, within radio-frequency or microwave signals received through the input port (i) of the fourth receiver filter 718, back through the input port (i) of the fourth receiver filter 718.

In some embodiments, the fourth predetermined receiver radio-frequency or microwave band is distinct from the first predetermined receiver radio-frequency or microwave band. In some embodiments, the fourth predetermined receiver radio-frequency or microwave band does not overlap with the first predetermined receiver radio-frequency or microwave band. In some embodiments, the fourth predetermined receiver radio-frequency or microwave band is distinct from the second predetermined receiver radio-frequency or microwave band. In some embodiments, the fourth predetermined receiver radio-frequency or microwave band does not overlap with the second predetermined receiver radio-frequency or microwave band. In some embodiments, the fourth predetermined receiver radio-frequency or microwave band is distinct from the third predetermined receiver radio-frequency or microwave band. In some embodiments, the fourth predetermined receiver radio-frequency or microwave band does not overlap with the third predetermined receiver radio-frequency or microwave band.

The device includes a third transmitter filter 712 that includes an input port (i) and an output port (o) that is distinct from the input port (i). In some embodiments, the third transmitter filter 712 is configured to transmit radio-frequency or microwave signals that satisfy a third predetermined transmitter radio-frequency or microwave band, within radio-frequency or microwave signals received through the input port (i) of the third transmitter filter 712, through the output port (o) of the third transmitter filter 712. In some embodiments, the third transmitter filter 712 is configured to suppress radio-frequency or microwave signals that do not satisfy the third predetermined transmitter radio-frequency or microwave band, within radio-frequency or microwave signals received through the input port (i) of the third transmitter filter 712, from being output through the output port (o) of the third transmitter filter 712.

In some embodiments, the third predetermined transmitter radio-frequency or microwave band is distinct from the first predetermined transmitter radio-frequency or microwave band. In some embodiments, the third predetermined transmitter radio-frequency or microwave band does not overlap with the first predetermined transmitter radio-frequency or microwave band. In some embodiments, the third predetermined transmitter radio-frequency or microwave band is distinct from the second predetermined transmitter radio-frequency or microwave band. In some embodiments, the third predetermined transmitter radio-frequency or microwave band does not overlap with the second predetermined transmitter radio-frequency or microwave band.

The device includes a fourth transmitter filter 714 that includes an input port (i) and an output port (o) that is distinct from the input port (i). The fourth transmitter filter 714 is distinct from the third transmitter filter 712. In some embodiments, the fourth transmitter filter 714 is configured to transmit radio-frequency or microwave signals that satisfy a fourth predetermined transmitter radio-frequency or microwave band, within radio-frequency or microwave signals received through the input port (i) of the fourth transmitter filter 714, through the output port (o) of the fourth transmitter filter 714. In some embodiments, the fourth transmitter filter 714 is configured to suppress radio-frequency or microwave signals that do not satisfy the fourth predetermined transmitter radio-frequency or microwave band, within radio-frequency or microwave signals received through the input port (i) of the fourth transmitter filter 714, from being output through the output port (o) of the fourth transmitter filter 714.

In some embodiments, the fourth predetermined transmitter radio-frequency or microwave band is distinct from the first predetermined transmitter radio-frequency or microwave band. In some embodiments, the fourth predetermined transmitter radio-frequency or microwave band does not overlap with the first predetermined transmitter radio-frequency or microwave band. In some embodiments, the fourth predetermined transmitter radio-frequency or microwave band is distinct from the second predetermined transmitter radio-frequency or microwave band. In some embodiments, the fourth predetermined transmitter radio-frequency or microwave band does not overlap with the second predetermined transmitter radio-frequency or microwave band. In some embodiments, the fourth predetermined transmitter radio-frequency or microwave band is distinct from the third predetermined transmitter radio-frequency or microwave band. In some embodiments, the fourth predetermined transmitter radio-frequency or microwave band does not overlap with the third predetermined transmitter radio-frequency or microwave band.

The device includes a fourth circulator 722 that includes a first port (1), a second port (2), and a third port (3). The second port (2) is distinct from the first port (1). The third port (3) is distinct from the first port (1) and the second port (2). The fourth circulator 722 is distinct from the first circulator 602, the second circulator 604, and the third circulator 606.

The first port (1) of the fourth circulator 722 is coupled with the output port (o) of the third transmitter filter 712. The third port (3) of the fourth circulator 722 is coupled with the output port (o) of the fourth transmitter filter 714.

The device includes a fifth circulator 724 that includes a first port (1), a second port (2), and a third port (3). The second port (2) is distinct from the first port (1). The third port (3) is distinct from the first port (1) and the second port (2). The fifth circulator 724 is distinct from the first circulator 602, the second circulator 604, the third circulator 606, and the fourth circulator 722.

The second port (2) of the fifth circulator 724 is coupled with the input port (i) of the third receiver filter 716. The third port (3) of the fifth circulator 724 is coupled with the input port (i) of the fourth receiver filter 718.

The device includes a sixth circulator 726 that includes a first port (1), a second port (2), and a third port (3). The second port (2) is distinct from the first port (1). The third port (3) is distinct from the first port (1) and the second port (2). The sixth circulator 726 is distinct from the first circulator 602, the second circulator 604, the third circulator 606, the fourth circulator 722, and the fifth circulator 724.

The first port (1) of the sixth circulator 726 is coupled with the second port (2) of the fourth circulator 722. The third port (3) of the sixth circulator 726 is coupled with the first port (1) of the fifth circulator 724. The sixth circulator 726 is configured to route radio-frequency or microwave signals received through the first port (1) of the sixth circulator 726 to the second port (2) of the sixth circulator 726 and route radio-frequency or microwave signals received through the second port (2) of the sixth circulator 726 to the third port (3) of the sixth circulator 726. The second port (2) of the third circulator 606 and the second port (2) of the sixth circulator 726 are coupled with the splitter 728.

Thus, four transmitters (504, 506, 704, and 706) and four receivers (508, 510, 708, and 710) are coupled with an antenna using the device illustrated in FIG. 7A. Compared to the loss of a traditional configuration that includes at least three splitters, the loss of the system illustrated in FIG. 7A is reduced (e.g., by at least 5 dB).

In some embodiments, the fourth circulator 722 is configured to route radio-frequency or microwave signals received through the first port (1) of the fourth circulator 722 to the second port (2) of the fourth circulator 722 and route radio-frequency or microwave signals received through the third port (3) of the fourth circulator 722 to the first port (1) of the fourth circulator 722.

In some embodiments, the fourth circulator 722 is configured to route radio-frequency or microwave signals received through the first port (1) of the fourth circulator 722 to the third port (3) of the fourth circulator 722 and route radio-frequency or microwave signals received through the third port (3) of the fourth circulator 722 to the second port (2) of the fourth circulator 722.

In some embodiments, the fifth circulator 724 is configured to route radio-frequency or microwave signals received through the first port (1) of the fifth circulator 724 to the second port (2) of the fifth circulator 724 and route radio-frequency or microwave signals received through the second port (2) of the fifth circulator 724 to the third port (3) of the fifth circulator 724.

In some embodiments, the fifth circulator 724 is configured to route radio-frequency or microwave signals received through the first port (1) of the fifth circulator 724 to the third port (3) of the fifth circulator 724 and route radio-frequency or microwave signals received through the third port (3) of the fifth circulator 724 to the second port (2) of the fifth circulator 724.

In some embodiments, the device includes a fifth isolator that includes an input port (i) and an output port (o) that is distinct from the input port (i). The input port (i) of the fifth isolator is coupled with the output port (o) of the third receiver filter. In some embodiments, the fifth isolator is configured to transmit radio-frequency or microwave signals received through the input port (i) of the fifth isolator to the output port (o) of the fifth isolator. In some embodiments, the fifth isolator is configured to suppress radio-frequency or microwave signals received through the output port (o) of the fifth isolator from being output through the input port (i) of the fifth isolator.

In some embodiments, the device includes a sixth isolator that includes an input port (i) and an output port (o) that is distinct from the input port (i). The sixth isolator is distinct from the fifth isolator. The input port (i) of the sixth isolator is coupled with the output port (o) of the fourth receiver filter. In some embodiments, the sixth isolator is configured to transmit radio-frequency or microwave signals received through the input port (i) of the sixth isolator to the output port (o) of the sixth isolator. In some embodiments, the sixth isolator is configured to suppress radio-frequency or microwave signals received through the output port (o) of the sixth isolator from being output through the input port (i) of the sixth isolator.

In some embodiments, the device includes a seventh isolator that includes an input port (i) and an output port (o) that is distinct from the input port (i). The seventh isolator is distinct from the fifth isolator and the sixth isolator. The output port (o) of the seventh isolator is coupled with the input port (i) of the third transmitter filter. The seventh isolator is configured to transmit radio-frequency or microwave signals received through the input port (i) of the seventh isolator to the output port (o) of the seventh isolator. The seventh isolator is configured to suppress radio-frequency or microwave signals received through the output port (o) of the seventh isolator from being output through the input port (i) of the seventh isolator.

In some embodiments, the device includes an eighth isolator that includes an input port (i) and an output port (o) that is distinct from the input port (i). The eighth isolator is distinct from the first isolator, the second isolator, and the third isolator. The output port (o) of the eighth isolator is coupled with the input port (i) of the fourth transmitter filter. In some embodiments, the eighth isolator is configured to transmit radio-frequency or microwave signals received through the input port (i) of the eighth isolator to the output port (o) of the eighth isolator. In some embodiments, the eighth isolator is configured to suppress radio-frequency or microwave signals received through the output port (o) of the eighth isolator from being output through the input port (i) of the eighth isolator.

Figure 7B:
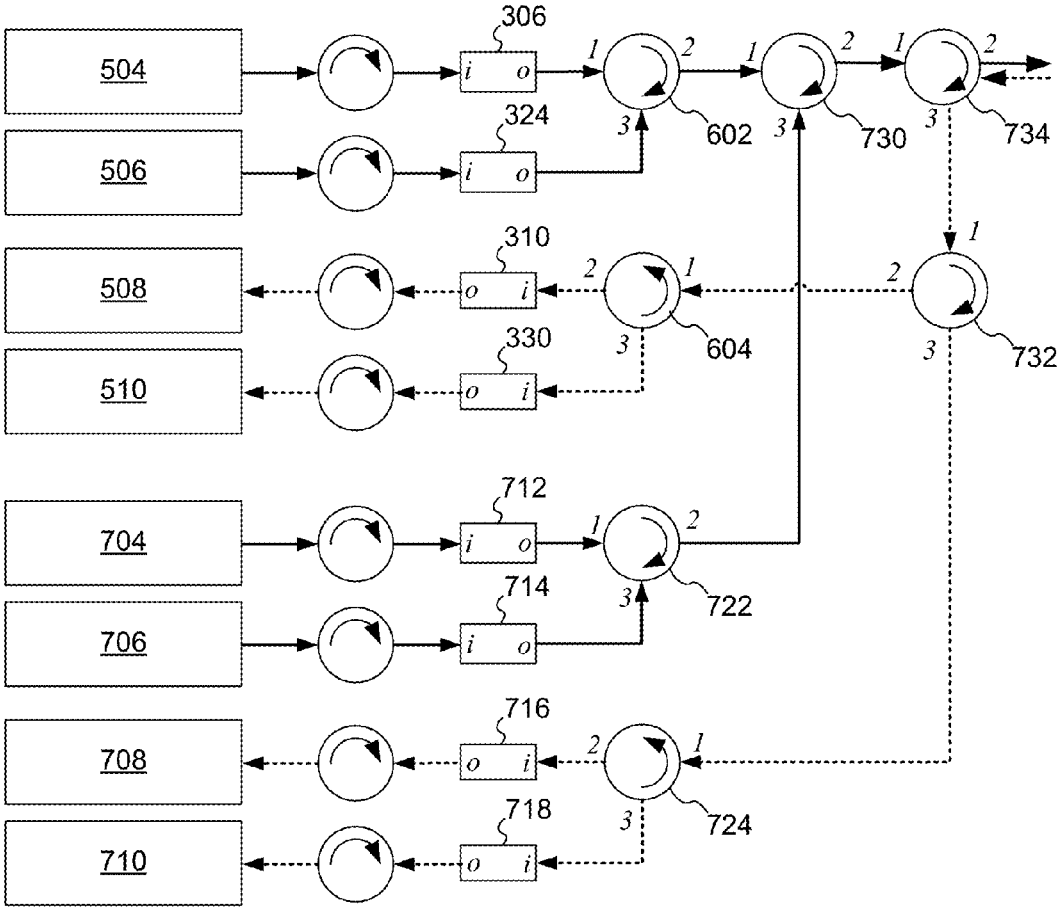
FIG. 7B is a schematic diagram illustrating a multi-radio-channel system in a 4+0 Frequency Diversity configuration in accordance with some embodiments.

FIG. 7B is a schematic diagram illustrating a multi-radio-channel system in a 4+0 Frequency Diversity configuration in accordance with some embodiments. The multi-radio-channel system illustrated in FIG. 7B is similar to the multi-radio-channel system illustrated in FIG. 7A except that the multi-radio-channel system illustrated in FIG. 7B includes a seventh circulator instead of the splitter 728 (FIG. 7A). By eliminating the splitter 728, the loss of the multi-radio-channel system illustrated in FIG. 7B is further reduced (E.g., 12 dB compared to the loss of a traditional configuration that includes at least three splitters.

For example, an antenna coupling device includes the first receiver filter 310, the second receiver filter 330, the first transmitter filter 306, the second transmitter filter 324, the first circulator 602, the second circulator 604, and the third circulator 734. The third circulator 734 is analogous to the third circulator 606 illustrated in FIG. 7A.

The device includes a third receiver filter 716 that includes an input port (i) and an output port (o) that is distinct from the input port (i). The third receiver filter 716 is configured to transmit radio-frequency or microwave signals that satisfy a third predetermined receiver radio-frequency or microwave band, within radio-frequency or microwave signals received through the input port (i) of the third receiver filter 716, through the output port (o) of the third receiver filter 716. In some embodiments, the third receiver filter 716 is configured to send back (e.g., by reflection) radio-frequency or microwave signals that do not satisfy the third predetermined receiver radio-frequency or microwave band, within radio-frequency or microwave signals received through the input port (i) of the third receiver filter 716, through the input port (i) of the third receiver filter 716. For example, the third receiver filter 716 is configured to reflect radio-frequency or microwave signals that do not satisfy the third predetermined receiver radio-frequency or microwave band, within radio-frequency or microwave signals received through the input port (i) of the third receiver filter 716, back through the input port (i) of the third receiver filter 716.

The device includes a fourth receiver filter 718 that includes an input port (i) and an output port (o) that is distinct from the input port (i). The fourth receiver filter 718 is distinct from the third receiver filter 716. In some embodiments, the fourth receiver filter 718 is configured to transmit radio-frequency or microwave signals that satisfy a fourth predetermined receiver radio-frequency or microwave band, within radio-frequency or microwave signals received through the input port (i) of the fourth receiver filter 718, through the output port (o) of the fourth receiver filter 718. In some embodiments, the fourth receiver filter 718 is configured to send back (e.g., by reflection) radio-frequency or microwave signals that do not satisfy the fourth predetermined receiver radio-frequency or microwave band, within radio-frequency or microwave signals received through the input port (i) of the fourth receiver filter 718, through the input port (i) of the fourth receiver filter 718. For example, the fourth receiver filter 718 is configured to reflect radio-frequency or microwave signals that do not satisfy the fourth predetermined receiver radio-frequency or microwave band, within radio-frequency or microwave signals received through the input port (i) of the fourth receiver filter 718, back through the input port (i) of the fourth receiver filter 718.

The device includes a third transmitter filter 712 that includes an input port (i) and an output port (o) that is distinct from the input port (i). In some embodiments, the third transmitter filter 712 is configured to transmit radio-frequency or microwave signals that satisfy a third predetermined transmitter radio-frequency or microwave band, within radio-frequency or microwave signals received through the input port (i) of the third transmitter filter 712, through the output port (o) of the third transmitter filter 712. In some embodiments, the third transmitter filter 712 is configured to suppress radio-frequency or microwave signals that do not satisfy the third predetermined transmitter radio-frequency or microwave band, within radio-frequency or microwave signals received through the input port (i) of the third transmitter filter 712, from being output through the output port (o) of the third transmitter filter 712.

The device includes a fourth transmitter filter 714 that includes an input port (i) and an output port (o) that is distinct from the input port (i). The fourth transmitter filter 714 is distinct from the third transmitter filter 712. In some embodiments, the fourth transmitter filter 714 is configured to transmit radio-frequency or microwave signals that satisfy a fourth predetermined transmitter radio-frequency or microwave band, within radio-frequency or microwave signals received through the input port (i) of the fourth transmitter filter 714, through the output port (o) of the fourth transmitter filter 714. In some embodiments, the fourth transmitter filter 714 is configured to suppress radio-frequency or microwave signals that do not satisfy the fourth predetermined transmitter radio-frequency or microwave band, within radio-frequency or microwave signals received through the input port (i) of the fourth transmitter filter 714, from being output through the output port (o) of the fourth transmitter filter 714.

The device includes a fourth circulator 722 that includes a first port (1), a second port (2), and a third port (3). The second port (2) is distinct from the first port (1). The third port (3) is distinct from the first port (1) and the second port (2). The fourth circulator 722 is distinct from the first circulator 602, the second circulator 604, and the third circulator 734. The first port (1) of the fourth circulator 722 is coupled with the output port (o) of the third transmitter filter 712. The third port (3) of the fourth circulator 722 is coupled with the output port (o) of the fourth transmitter filter 714.

The device includes a fifth circulator 724 that includes a first port (1), a second port (2), and a third port (3). The second port (2) is distinct from the first port (1). The third port (3) is distinct from the first port (1) and the second port (2). The fifth circulator 724 is distinct from the first circulator 602, the second circulator 604, the third circulator 734, and the fourth circulator 722. The second port (2) of the fifth circulator 724 is coupled with the input port (i) of the third receiver filter 716. The third port (3) of the fifth circulator 724 is coupled with the input port (i) of the fourth receiver filter 718.

The device includes a sixth circulator 730 that includes a first port (1), a second port (2), and a third port (3). The second port (2) is distinct from the first port (1). The third port (3) is distinct from the first port (1) and the second port (2). The sixth circulator 730 is distinct from the first circulator 602, the second circulator 604, the third circulator 734, the fourth circulator 722, and the fifth circulator 724. The first port (1) of the sixth circulator 730 is coupled with the second port (2) of the first circulator 602 and the second port (2) of the sixth circulator 730 is coupled with the first port (1) of the third circulator 734 so that the second port (2) of the first circulator 602 is coupled with the first port (1) of the third circulator 734 through the sixth circulator 730. The third port (3) of the sixth circulator 730 is coupled with the second port (2) of the fourth circulator 722.

The device includes a seventh circulator 732 that includes a first port (1), a second port (2), and a third port (3). The second port (2) is distinct from the first port (1). The third port (3) is distinct from the first port (1) and the second port (2). The seventh circulator 732 is distinct from the first circulator 602, the second circulator 604, the third circulator 734, the fourth circulator 722, the fifth circulator 724, and the sixth circulator 730. The first port (1) of the seventh circulator 732 is coupled with the third port (3) of the third circulator 734 and the second port (2) of the seventh circulator 732 is coupled with the first port (1) of the second circulator 604 so that the third port (3) of the third circulator 734 is coupled with the first port (1) of the second circulator 604 through the seventh circulator 732. The third port (3) of the seventh circulator is coupled with the first port (1) of the fifth circulator 724.

In some embodiments, the fourth circulator 722 is configured to route radio-frequency or microwave signals received through the first port (1) of the fourth circulator 722 to the second port (2) of the fourth circulator 722 and route radio-frequency or microwave signals received through the third port (3) of the fourth circulator 722 to the first port (1) of the fourth circulator 722.

In some embodiments, the fifth circulator 724 is configured to route radio-frequency or microwave signals received through the first port (1) of the fifth circulator 724 to the second port (2) of the fifth circulator 724 and route radio-frequency or microwave signals received through the second port (2) of the fifth circulator 724 to the third port (3) of the fifth circulator 724.

In some embodiments, the sixth circulator 730 is configured to route radio-frequency or microwave signals received through the first port (1) of the sixth circulator 730 to the second port (2) of the sixth circulator 730 and route radio-frequency or microwave signals received through the third port (3) of the sixth circulator 730 to the first port (1) of the sixth circulator 730.

In some embodiments, the sixth circulator 730 is configured to route radio-frequency or microwave signals received through the first port (1) of the sixth circulator 730 to the third port (3) of the sixth circulator 730 and route radio-frequency or microwave signals received through the third port (3) of the sixth circulator 730 to the second port (2) of the sixth circulator 730.

In some embodiments, the seventh circulator 732 is configured to route radio-frequency or microwave signals received through the first port (1) of the seventh circulator 732 to the third port (3) of the seventh circulator 732 and route radio-frequency or microwave signals received through the third port (3) of the seventh circulator 732 to the second port (2) of the seventh circulator 732.

In some embodiments, the seventh circulator 732 is configured to route radio-frequency or microwave signals received through the first port (1) of the seventh circulator 732 to the second port (2) of the seventh circulator 732 and route radio-frequency or microwave signals received through the second port (2) of the seventh circulator 732 to the third port (3) of the seventh circulator 732.

In some embodiments, the first circulator 602 and the second circulator 604 are formed using a first plate. The fourth circulator 722 and the fifth circulator 724 are formed using a second plate that is distinct from the first plate. The third circulator 734, the sixth circulator 730, and the seventh circulator 732 are formed using a third plate that is distinct from the first plate and the second plate. In some embodiments, the third plate is separate from the first plate and the second plate.

In some embodiments, all or a subset of the components illustrated in FIGS. 7A-7B except for the transmitters and receivers are implemented in an antenna coupling device. The transmitters and receivers couple with the antenna coupling device.

Certain features described above with respect to FIG. 7A are applicable to the system illustrated in FIG. 7B. For brevity, these details are not repeated herein.

Figure 8A:
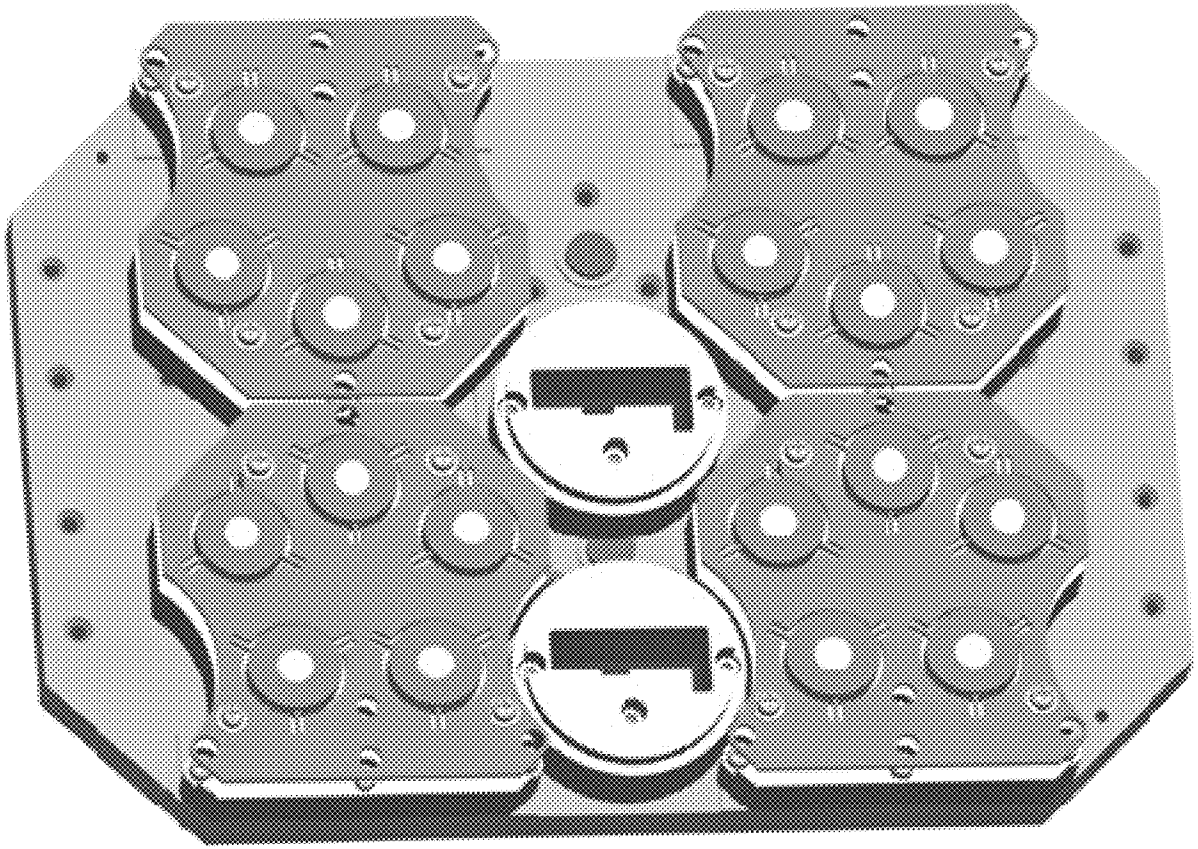
FIG. 8A is a perspective view of a dual-radio-channel system with tunable filters in accordance with some embodiments.

FIG. 8A is a perspective view of a dual-radio-channel system with tunable filters in accordance with some embodiments. The dual-radio-channel system includes the circulator plate illustrated in FIG. 4A and tunable filters.

A tunable filter is gaining popularity in radio-frequency communications due to its capability of tuning to different frequencies and different transmitter/receiver spacing. The tuning capability brings many advantages especially in field installation, as a single tunable filter can be used for one of multiple filter bands. For example, traditionally a system that operates with eight different bands requires eight different filters. To maintain such a system, an inventory of eight different filters is needed. Instead, a single tunable filter can be used. The tunable filter can be tuned to any of the eight different bands before installation, thereby eliminating the need for an inventory of eight different filters.

In addition, filters with a same size can be used on the circulator plate, which facilitates coupling of the filters and the circulator plate.

Figure 8B:
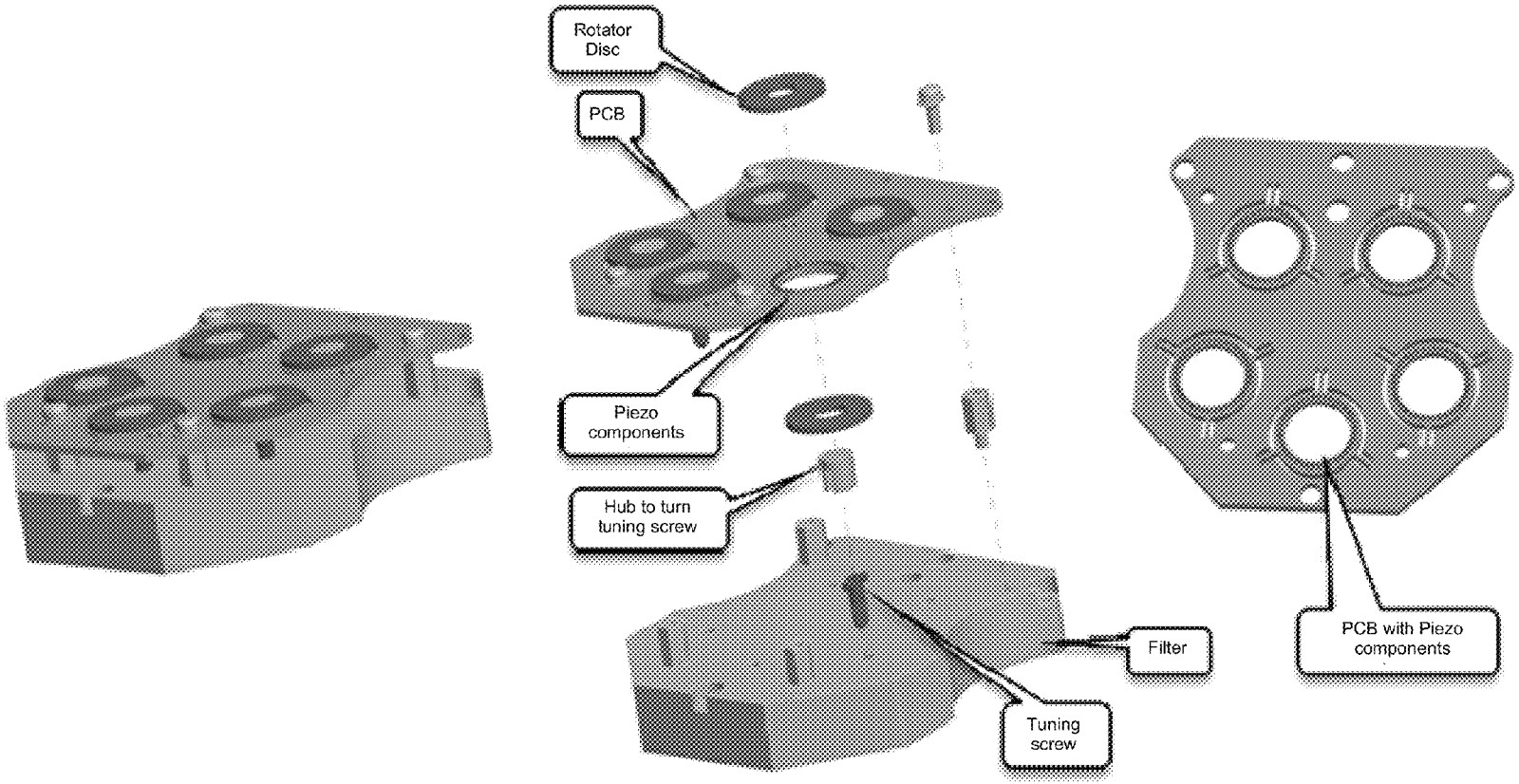
FIG. 8B is an exploded view of a tunable filter in accordance with some embodiments.

FIG. 8B is an exploded view of a tunable filter in accordance with some embodiments. In FIG. 8B, the tunable filter includes a printed circuit board (PCB) motor.

In some embodiments, the PCB motor contains many piezoelectric motors. PCB motor is integrated with a filter and is configured to turn a tuning screw to tune the frequency channel of the filter. The PCB motor is a small and, electrical controlled motor. The PCB motor is configured to maintain its position when the PCB motor is powered off. This contributes to power savings, as the PCB motor does not requires a constant supply of electricity to maintain its position. The use of the PCB allows remote control of the filters and hence the operation of the antenna coupling device. The PCB motor has a high-precision. Typically, the accuracy of the PCB motor can be achieved up to 1 micron due to multiplexing of multiple piezoelectric motors. In addition, the PCB motor has a low height.

Because the PCB motor can change the frequency channel of a filter, it can be used to tune the filter frequency channel in the field.

The terminology used in the description of the embodiments herein is for the purpose of describing particular embodiments only and is not intended to limit the scope of claims. As used in the description of the embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will also be understood that, although the terms first, second, etc. may be used herein to describe various elements, these elements should not be limited by these terms. These terms are only used to distinguish one element from another. For example, a first port could be termed a second port, and, similarly, a second port could be termed a first port, without departing from the scope of the embodiments. The first port and the second port are both ports, but they are not the same port.

As used herein, the terms "couple," "coupling," and "coupled" are used to indicate that multiple components are connected in a way such that a first component of the multiple components is capable of receiving a signal from a second component of the multiple components, unless indicated otherwise. In some cases, two components are indirectly coupled, indicating that one or more components (e.g., filters, waveguides, etc.) are located between the two components but a first component of the two components is capable of receiving signals from a second component of the two components.

As used herein, "mechanically coupling" indicates that components are structurally connected. However, mechanically coupled components are not necessarily configured to send and receive signals between them.

Although circulators are illustrated herein as having three ports, some circulators may have more than three ports (e.g., four ports) unless clearly indicated otherwise. For example, in some embodiments, the first circulator 108 illustrated in FIG. 1 has four or more ports. In some embodiments, a fourth port (and/or additional ports) of the first circulator is terminated.

Many modifications and alternative embodiments of the embodiments described herein will come to mind to one skilled in the art having the benefit of the teachings presented in the foregoing descriptions and the associated drawings. Therefore, it is to be understood that the scope of claims are not to be limited to the specific examples of the embodiments disclosed and that modifications and other embodiments are intended to be included within the scope of the appended claims. Although specific terms are employed herein, they are used in a generic and descriptive sense only and not for purposes of limitation.

The foregoing description, for purpose of explanation, has been described with reference to specific embodiments. However, the illustrative discussions above are not intended to be exhaustive or to limit the scope of claims to the precise forms disclosed. Many modifications and variations are possible in view of the above teachings.

For example, in accordance with some embodiments, an antenna coupling device includes a single circulator plate; a plurality of circulators formed using the single circulator plate; a plurality of isolators formed using the single circulator plate; and a plurality of filters formed independent of the single circulator plate. The plurality of filters is removably coupled with the single circulator plate.

The embodiments were chosen and described in order to best explain the underlying principles and their practical applications, to thereby enable others skilled in the art to best utilize the underlying principles and various embodiments with various modifications as are suited to the particular use contemplated.

What is claimed is:

1. A device for routing microwave signals, comprising:

a first receiver filter that includes an input port and an output port;

a second receiver filter that includes an input port and an output port;

a first transmitter filter that includes an input port and an output port;

a second transmitter filter that includes an input port and an output port;

a first circulator that includes a first port, a second port, and a third port, wherein:

the first port of the first circulator is coupled with the output port of the first transmitter filter; and the third port of the first circulator is coupled with the output port of the second transmitter filter;

a second circulator that includes a first port, a second port, and a third port, wherein:

the second port of the second circulator is coupled with the input port of the first receiver filter; and the third port of the second circulator is coupled with the input port of the second receiver filter; and a third circulator that includes a first port, a second port, and a third port, wherein:

the first port of the third circulator is coupled with the second port of the first circulator; and the third port of the third circulator is coupled with the first port of the second circulator.

2. The device of claim 1, wherein the first circulator is configured to route radio-frequency or microwave signals received through the first port of the first circulator to the second port of the first circulator and route radio-frequency or microwave signals received through the third port of the first circulator to the first port of the first circulator.

3. The device of claim 1, wherein the second circulator is configured to route radio-frequency or microwave signals received through the first port of the second circulator to the second port of the second circulator and route radio-frequency or microwave signals received through the second port of the second circulator to the third port of the second circulator.

4. The device of claim 1, wherein the second port of the third circulator is configured for coupling with an antenna.

5. The device of claim 1, further comprising:

a first isolator that includes an input port and an output port, wherein:

the input port of the first isolator is coupled with the output port of the first receiver filter;

a second isolator that includes an input port and an output port, wherein:

the input port of the second isolator is coupled with the output port of the second receiver filter;

a third isolator that includes an input port and an output port, wherein:

the output port of the third isolator is coupled with the input port of the first transmitter filter; and a fourth isolator that includes an input port and an output port, wherein:

the output port of the fourth isolator is coupled with the input port of the second transmitter filter.

6. The device of claim 5, wherein each isolator is a circulator that includes a first port, a second port, and a third port, wherein only one of the first port, the second port, and the third port is terminated with a matched load.

7. The device of claim 5, wherein:

the output port of the first receiver filter is coupled with a first receiver through the first isolator;

the output port of the second receiver filter is coupled with a second receiver through the second isolator;

the input port of the first transmitter filter is coupled with a first transmitter through the third isolator; and the input port of the second transmitter filter is coupled with a second transmitter through the fourth isolator.

8. The device of claim 1, wherein at least one of the first receiver filter, the second receiver filter, the first transmitter filter, and the second transmitter filter is a tunable filter.

9. The device of claim 1, wherein the first circulator, the second circulator, and the third circulator are formed using a single plate.

10. The device of claim 1, further comprising:

a third receiver filter that includes an input port and an output port;

a fourth receiver filter that includes an input port and an output port;

a third transmitter filter that includes an input port and an output port;

a fourth transmitter filter that includes an input port and an output port;

a fourth circulator that includes a first port, a second port, and a third port, wherein:

the first port of the fourth circulator is coupled with the output port of the third transmitter filter; and the third port of the fourth circulator is coupled with the output port of the fourth transmitter filter;

a fifth circulator that includes a first port, a second port, and a third port, wherein:

the second port of the fifth circulator is coupled with the input port of the third receiver filter; and the third port of the fifth circulator is coupled with the input port of the fourth receiver filter;

a sixth circulator that includes a first port, a second port, and a third port, wherein:

the first port of the sixth circulator is coupled with the second port of the fourth circulator;

the third port of the sixth circulator is coupled with the first port of the fifth circulator; and the second port of the third circulator and the second port of the sixth circulator are coupled with a splitter.

11. The device of claim 10, wherein the fourth circulator is configured to route radio-frequency or microwave signals received through the first port of the fourth circulator to the second port of the fourth circulator and route radio-frequency or microwave signals received through the third port of the fourth circulator to the first port of the fourth circulator.

12. The device of claim 10, wherein the fifth circulator is configured to route radio-frequency or microwave signals received through the first port of the fifth circulator to the second port of the fifth circulator and route radio-frequency or microwave signals received through the second port of the fifth circulator to the third port of the fifth circulator.

13. The device of claim 10, further comprising:

a fifth isolator that includes an input port and an output port, wherein:

the input port of the fifth isolator is coupled with the output port of the third receiver filter;

a sixth isolator that includes an input port and an output port, wherein:

the input port of the sixth isolator is coupled with the output port of the fourth receiver filter;

a seventh isolator that includes an input port and an output port, wherein:

the output port of the seventh isolator is coupled with the input port of the third transmitter filter; and an eighth isolator that includes an input port and an output port, wherein:

the output port of the eighth isolator is coupled with the input port of the fourth transmitter filter.

14. The device of claim 1, further comprising:

a third receiver filter that includes an input port and an output port;

a fourth receiver filter that includes an input port and an output port;

a third transmitter filter that includes an input port and an output port;

a fourth transmitter filter that includes an input port and an output port;

a fourth circulator that includes a first port, a second port, and a third port, wherein:

the first port of the fourth circulator is coupled with the output port of the third transmitter filter; and the third port of the fourth circulator is coupled with the output port of the fourth transmitter filter;

a fifth circulator that includes a first port, a second port, and a third port, wherein:

the second port of the fifth circulator is coupled with the input port of the third receiver filter; and the third port of the fifth circulator is coupled with the input port of the fourth receiver filter;

a sixth circulator that includes a first port, a second port, and a third port, wherein:

the first port of the sixth circulator is coupled with the second port of the first circulator and the second port of the sixth circulator is coupled with the first port of the third circulator so that the second port of the first circulator is coupled with the first port of the third circulator through the sixth circulator; and the third port of the sixth circulator is coupled with the second port of the fourth circulator; and a seventh circulator that includes a first port, a second port, and a third port, wherein:

the first port of the seventh circulator is coupled with the third port of the third circulator and the second port of the seventh circulator is coupled with the first port of the second circulator so that the third port of the third circulator is coupled with the first port of the second circulator through the seventh circulator; and the third port of the seventh circulator is coupled with the first port of the fifth circulator.

15. The device of claim 14, wherein the fourth circulator is configured to route radio-frequency or microwave signals received through the first port of the fourth circulator to the second port of the fourth circulator and route radio-frequency or microwave signals received through the third port of the fourth circulator to the first port of the fourth circulator.

16. The device of claim 14, wherein the fifth circulator is configured to route radio-frequency or microwave signals received through the first port of the fifth circulator to the second port of the fifth circulator and route radio-frequency or microwave signals received through the second port of the fifth circulator to the third port of the fifth circulator.

17. The device of claim 14, wherein the sixth circulator is configured to route radio-frequency or microwave signals received through the first port of the sixth circulator to the second port of the sixth circulator and route radio-frequency or microwave signals received through the third port of the sixth circulator to the first port of the sixth circulator.

18. The device of claim 14, wherein the seventh circulator is configured to route radio-frequency or microwave signals received through the first port of the seventh circulator to the third port of the seventh circulator and route radio-frequency or microwave signals received through the third port of the seventh circulator to the second port of the seventh circulator.

19. The device of claim 14, wherein:

the first circulator and the second circulator are formed using a first plate;

the fourth circulator and the fifth circulator are formed using a second plate; and the third circulator, the sixth circulator, and the seventh circulator are formed using a third plate.

20. A two-transmitter two-receiver wireless communication system, comprising:

a first receiver;

a second receiver;

a first transmitter;

a second transmitter; and an antenna coupling device selected from a plurality of antenna coupling devices, wherein:

the first receiver, the second receiver, the first transmitter, the second transmitter are configured for coupling with any antenna coupling device of the plurality of antenna coupling devices;

each antenna coupling device of the plurality of antenna coupling devices has an input waveguide port for coupling with the first receiver at a same first location and an output waveguide port for coupling with the first transmitter at a same second location; and the first receiver, the second receiver, the first transmitter, the second transmitter are coupled with the antenna coupling device.

* * * * *